US010379465B2

(12) United States Patent
Shiokawa et al.

(10) Patent No.: US 10,379,465 B2
(45) Date of Patent: Aug. 13, 2019

(54) IMAGE FORMING APPARATUS AND IMAGE FORMING METHOD WITH PAPER HEATING CONTROL

(71) Applicant: KONICA MINOLTA, INC., Chiyoda-ku, Tokyo (JP)

(72) Inventors: Yasuo Shiokawa, Hino (JP); Yoshiteru Kawakami, Kokubunji (JP); Takahiro Okubo, Yokohama (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/033,674

(22) Filed: Jul. 12, 2018

(65) Prior Publication Data

US 2019/0018352 A1 Jan. 17, 2019

(30) Foreign Application Priority Data

Jul. 13, 2017 (JP) ..... 2017-136754
Jul. 18, 2017 (JP) ..... 2017-138694
Jul. 18, 2017 (JP) ..... 2017-138695

(51) Int. Cl.
*G03G 15/00* (2006.01)
*G03G 15/20* (2006.01)

(52) U.S. Cl.
CPC ..... *G03G 15/2028* (2013.01); *G03G 15/2053* (2013.01); *G03G 15/2064* (2013.01); *G03G 15/602* (2013.01); *G03G 15/6511* (2013.01)

(58) Field of Classification Search
CPC ..... G03G 15/2028; G03G 15/2053; G03G 15/2064; G03G 15/602; G03G 15/65; G03G 15/6511; G03G 15/6573; G03G 15/6576; G03G 15/6579; G03G 2215/0043; G03G 2215/00438
See application file for complete search history.

(56) References Cited

U.S. PATENT DOCUMENTS 5,140,442 A * 8/1992 Shigemura ..... G03G 15/65 358/401
6,219,502 B1 * 4/2001 Osari ..... H04N 1/00915 399/82

(Continued)

FOREIGN PATENT DOCUMENTS

JP 06-258970 A 9/1994
JP 2006-298605 A 11/2006
JP 2011-039318 A 2/2011

*Primary Examiner* — Sophia S Chen
(74) *Attorney, Agent, or Firm* — Buchanan Ingersoll & Rooney PC

(57) ABSTRACT

An image forming apparatus includes an image former, a fixing device, an image forming path, a circulation path and a hardware processor. Along the image forming path, paper is conveyed to the image former and the fixing device. The circulation path (i) diverges from the image forming path on a downstream side of the fixing device in a paper conveying direction and (ii) meets the image forming path on an upstream side of the image former in the paper conveying direction so as to circulate the paper such that an image forming side of the paper is unchanged. The hardware processor performs paper heating control to (i) make the paper pass through the fixing device without image forming on the paper, thereby heating the paper, and (ii) re-convey the paper via the circulation path to the image former.

19 Claims, 11 Drawing Sheets

(56) References Cited

U.S. PATENT DOCUMENTS

| | | | | |
|---|---|---|---|---|
| 2007/0291327 | A1* | 12/2007 | Saito | G03G 15/235 358/496 |
| 2013/0058694 | A1* | 3/2013 | Miyajima | G03G 15/6579 399/401 |
| 2017/0090391 | A1* | 3/2017 | Awano | B65H 37/06 |

* cited by examiner

FIG.3A

LOW HUMIDITY

121a

| | | | SINGLE-SIDED PRINTING | DOUBLE-SIDED PRINTING | |
|---|---|---|---|---|---|
| | | | | FIRST SIDE | SECOND SIDE |
| LONG | THICK PAPER | A | PREHEATING | PREHEATING | PREHEATING |
| | THIN PAPER | B | CURL PREVENTION | PREHEATING | NONE |
| STANDARD-SIZE | THICK PAPER | C | PREHEATING | PREHEATING | PREHEATING |
| | THIN PAPER | D | CURL PREVENTION | NONE | NONE |

FIG.3B

HIGH HUMIDITY

121b

| | | | SINGLE-SIDED PRINTING | DOUBLE-SIDED PRINTING | |
|---|---|---|---|---|---|
| | | | | FIRST SIDE | SECOND SIDE |
| LONG | THICK PAPER | A | PREHEATING | PREHEATING | PREHEATING |
| | THIN PAPER | B | CURL PREVENTION | PREHEATING | NONE |
| STANDARD-SIZE | THICK PAPER | C | PREHEATING | PREHEATING | PREHEATING |
| | THIN PAPER | D | CURL PREVENTION | PREHEATING | NONE |

IMAGE FORMING APPARATUS AND IMAGE FORMING METHOD WITH PAPER HEATING CONTROL

BACKGROUND

1. Technological Field

The present invention relates to an image forming apparatus and an image forming method.

2. Description of the Related Art

In recent years, multifunctional image forming apparatuses having functions of a printer, a scanner, a copier, a facsimile and so forth have been widely used. This type of image forming apparatus uses an electrophotographic method of developing an electrostatic latent image(s) formed on a photoreceptor(s) with a toner(s), thereby forming a toner image(s), transferring the formed toner image to paper, and fixing by heat the toner image transferred to the paper by making the toner image pass through a nip part formed by a pair of fixing members heated in a fixing device, thereby forming an image(s) on the paper.

In general, as picture images, images having high glossiness are preferred. Meanwhile, in business documents, images having low glossiness are often preferred. Hence, an image forming apparatus that can output high gloss to low gloss images is desired.

However, in the electrophotographic method, when paper passes through the fixing device, heat of the fixing members is absorbed by the paper, which reduces the fixing temperature. This causes poor fixing and/or decrease in glossiness of images, and accordingly images desired by users may not be provided.

In order to deal with this problem, there is disclosed in Japanese Patent Application Publication No. 2011-039318 a technology of, with a heating device that can heat paper in a paper feeding tray, warming the paper in advance before the paper reaches a fixing device, thereby suppressing decrease in temperature of fixing members.

Further, there is disclosed in Japanese Patent Application Publication No. H06-258970 an image forming apparatus having a plurality of fixing devices. This image forming apparatus can ensure a certain level of fixing properties by a first fixing device arranged on the upstream side and provide gloss by a second fixing device arranged on the downstream side of the first fixing device.

However, the technology disclosed in Japanese Patent Application Publication No. 2011-039318 warms around the paper feeding tray and warms the paper by the convective heat transfer. Hence, thermal efficiency is low, and accordingly the paper does not warm up quickly. Thus, this technology consumes electronic power and requires time before starting printing.

Further, the technology disclosed in Japanese Patent Application Publication No. H06-258970 requires two fixing devices, which leads to increase in size and costs of image forming apparatuses.

SUMMARY

The present invention has been conceived in view of the above problems, and objects of the present invention include providing, without increasing size or costs of image forming apparatuses, an image forming apparatus and an image forming method that can ensure fixing properties and control glossiness of images.

In order to achieve at least one of the abovementioned objects, according to an aspect of the present invention, there is provided an image forming apparatus including: an image former that forms a toner image on paper; a fixing device that fixes by heat the toner image formed on the paper by the image former; an image forming path along which the paper is conveyed to the image former and the fixing device; a circulation path that (i) diverges from the image forming path on a downstream side of the fixing device in a paper conveying direction and (ii) meets the image forming path on an upstream side of the image former in the paper conveying direction so as to circulate the paper such that an image forming side of the paper is unchanged; and a hardware processor that performs paper heating control to (i) make the paper pass through the heated fixing device without image forming on the paper, thereby heating the paper, and (ii) re-convey the paper via the circulation path to the image former.

BRIEF DESCRIPTION OF THE DRAWINGS

The advantages and features provided by one or more embodiments of the present invention will become more fully understood from the detailed description given hereinbelow and the appended drawings which are given by way of illustration only, and thus are not intended as a definition of the limits of the present invention, wherein:

FIG. 3A shows an example of data stored in a paper heating control table;

FIG. 3B shows another example of data stored in the paper heating control table;

DETAILED DESCRIPTION OF EMBODIMENTS

Hereinafter, embodiments to carry out the present invention will be described with reference to the drawings. A variety of limitations that are technically preferable for carrying out the present invention are put on the embodiments described below. However, the scope of the present invention is not limited to the disclosed embodiments or illustrated examples.

Hereinafter, embodiments of the present invention will be described in detail on the basis of the drawings. However, the scope of the present invention is not limited to the illustrated examples.

First Embodiment

[Configuration of Image Forming Apparatus 100]

First, configuration of an image forming apparatus 100 according to a first embodiment is described.

Figure 1:
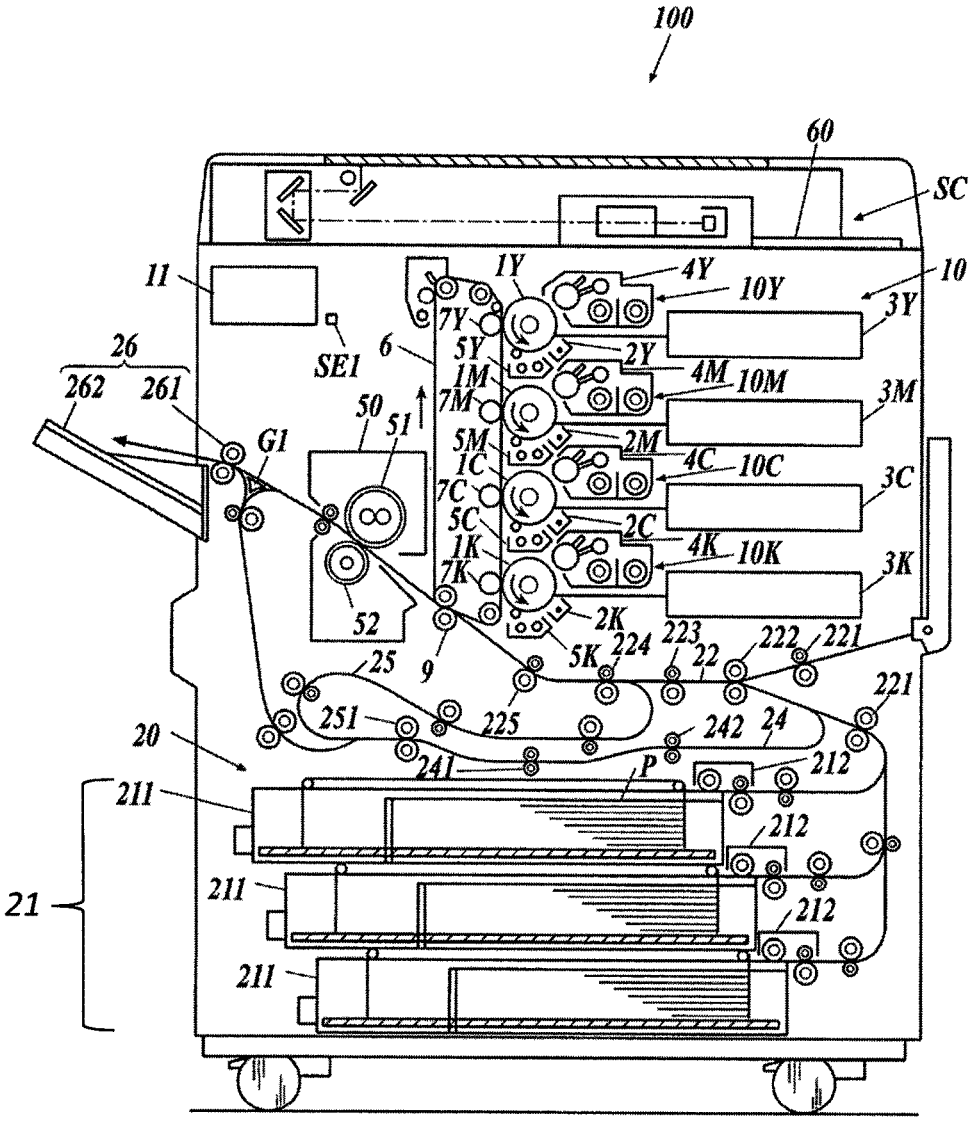
FIG. 1 schematically shows configuration of an image forming apparatus according to a first embodiment.

FIG. 1 schematically shows the image forming apparatus 100 according to this embodiment. This image forming apparatus 100 is an electrophotographic image forming apparatus, such as a copier, and, what is called, a tandem color image forming apparatus having photoreceptors arranged in a vertical direction in such a way as to face one intermediate transfer belt, thereby forming full-color images.

The image forming apparatus 100 includes a document scanner SC, an image former 10, a fixing device 50, an image reader 60 and a controller 11 as main components, and these components are housed in one casing.

The document scanner SC scans and thereby exposes images of documents with an optical system of a scanning exposure device, and reads the reflected light with a line image sensor, thereby obtaining image signals. The image signals are input to the controller 11 as image data after being subjected to image processing, such as A/D conversion, shading correction and compression. The image data input to the controller 11 are not limited to those read by the document scanner SC, and may be image data received by a communication unit 13 from a personal computer or another image forming apparatus connected to the image forming apparatus 100.

The image former 10 includes four image forming units 10Y, 10M, 10C, 10K, an intermediate transfer belt 6, and a secondary transfer roller pair 9. The image forming units 10Y, 10M, 10C, 10K form yellow (Y) images, magenta (M) images, cyan (C) images and black (K) images, respectively.

The image forming unit 10Y includes: a photoconductive drum 1Y; and a charger 2Y, an optical writer 3Y, a developing device 4Y and a drum cleaner 5Y arranged around the photoconductive drum 1Y. Similarly, the image forming units 10M, 10C, 10K include: photoconductive drums 1M, 1C, 1K; and chargers 2M, 2C, 2K, optical writers 3M, 3C, 3K, developing devices 4M, 4C, 4K and drum cleaners 5M, 5C, 5K arranged around their respective photoconductive drums 1M, 1C, 1K.

The chargers 2Y, 2M, 2C, 2K charge surfaces of the photoconductive drums 1Y, 1M, 1C, 1K uniformly, and the optical writers 3Y, 3M, 3C, 3K form latent images on the photoconductive drums 1Y, 1M, 1C, 1K by scanning exposure. The developing devices 4Y, 4M, 4C, 4K visualize the latent images on the photoconductive drums 1Y, 1M, 1C, 1K by developing the latent images with toners, thereby forming toner images of predetermined colors corresponding to yellow, magenta, cyan and black on the photoconductive drums 1Y, 1M, 1C, 1K. The toner images formed on the photoconductive drums 1Y, 1M, 1C, 1K are successively transferred by primary transfer rollers 7Y, 7M, 7C, 7K onto a predetermined point on the rotating intermediate transfer belt 6.

The toner image of the colors transferred onto the intermediate transfer belt 6 is transferred by the secondary transfer roller pair 9 onto paper P conveyed thereto by the below-described paper conveyor 20 at a predetermined timing. The secondary transfer roller pair 9 is a pressure contact member that forms a nip part (hereinafter "transfer nip part") by being arranged to press and contact the intermediate transfer belt 6.

The paper conveyor 20 conveys the paper P along a paper conveyance path of the paper P. The paper conveyor 20 includes a paper feeder 21, an image forming path 22, a switching gate G1, a circulation path 24, an ADU reverse path 25 and a paper ejector 26.

The paper feeder 21 includes paper feeding trays 211 and paper feeding units 212. The paper P is housed in the paper feeding tray(s) 211. The paper P housed in the paper feeding tray 211 is taken by the paper feeding unit 212 to be sent out to the image forming path 22. Alternatively, the paper P may be housed in a paper feeding tray(s) of a paper feeding apparatus (not shown) connected to the image forming apparatus 100. The paper P which the paper feeding apparatus has is supplied from this paper feeding apparatus to the image forming apparatus 100 and sent out to the image forming path 22.

The image forming path 22 is a path along which the paper P is conveyed from the paper feeder 21 to the switching gate G1 in a paper conveying direction. On the upstream side of the transfer nip part, the image forming path 22 is provided with conveying units that convey the paper P. Each conveying unit is constituted of a pair of rollers that press against and contact with each other, and at least one of the rollers is rotationally driven through a drive mechanism that includes an electric motor as a main component, thereby conveying the paper P. Each pair of rollers constituting each conveying unit is configured to switch its inter-roller state between a press-and-contact state and a separate state.

In this embodiment, the image forming path 22 is provided with intermediate conveying roller pairs 221, 222, 223, a loop roller pair 224 and a registration roller pair 225 as the conveying units arranged in this order from the upstream side to the downstream side. Each conveying unit is not limited to a pair of rollers as described above, and can be a pair of any rotational members of a wide range. For example, a conveying unit may be a combination of belts or a combination of a belt and a roller.

Along this image forming path 22, the paper P fed from the paper feeding tray 211 or the paper feeding tray of the paper feeding apparatus is conveyed by the intermediate conveying roller pairs 221, 222 and 223 and then the loop roller pair 224 arranged from the upstream side to the downstream side, thereby running on the image forming path 22.

When the top of the paper P conveyed by the loop roller pair 224 and so forth approaches the registration roller pair 225, the paper P abuts the registration roller pair 225 that is in a rotation-suspended state, and a loop (warp) is formed on the paper P by the loop roller pair 224 still rotating for a predetermined period of time. By action of this loop forming, a skew of the top of the paper P is corrected.

When the registration roller pair 225 restarts rotating at a predetermined timing such that the position of the paper P can be proper for the toner image held by the intermediate transfer belt 6, the intermediate conveying roller pairs 221 to 223 and the loop roller pair 224 switch from the press-and-contact state to the separate state. That is, when the loop roller pair 224 switches to the separate state, the paper P is conveyed by the registration roller pair 225 only. The registration roller pair 225 conveys the paper P to the transfer nip part constituted of the intermediate transfer belt 6 as an image holder and the secondary transfer roller pair 9 as a transfer unit.

As shown in FIG. 1, the fixing device 50 is a device that performs a fixing process on the paper P onto which the toner image has been transferred, namely, on the paper P having been sent out from the transfer nip part, and includes: a pair of fixing members (e.g. a pair of a fixing roller 51 around which a fixing belt is wound and a pressurizing roller 52 which presses and contacts the fixing roller 51); and a heater that heats one or both of the fixing members. The heater is arranged inside the fixing roller 51 and heats the fixing roller 51 and the fixing belt. In the process of conveyance of the paper P, the fixing device 50 fixes the toner image to the paper P by pressure and heat of the fixing members.

The switching gate G1 is provided on the downstream side of the fixing device 50 in the paper conveying direction, and switches the path for the paper P to be conveyed, the paper P having been conveyed to the switching gate G1 along the image forming path 22. That is, if the paper P having passed through the fixing device 50 is conveyed to the circulation path 24 or the ADU reverse path 25, the switching gate G1 guides the paper P downward, whereas if the paper P is ejected by the paper ejector 26, the switching gate G1 makes the paper P go straight.

The circulation path 24 is arranged on the downstream side of the fixing device 50 in the paper conveying direction, and diverges from the image forming path 22 by the switching gate G1. Circulation roller pairs 241, 242 provided on the circulation path 24 from the upstream side to the downstream side as conveying units convey, to the downstream side, the paper P guided to the circulation path 24 by the switching gate G1. As shown in FIG. 1, the downstream-side end of the circulation path 24 is connected to the image forming path 22. That is, the paper P conveyed along the circulation path 24 meets the image forming path 22 again without being reversed.

On the circulation path 24, a reverse roller pair 251 is arranged and conveys the paper P to the ADU reverse path 25 as described below.

The ADU (Automatic Duplexing Unit) reverse path 25 is a path along which the paper P is conveyed in double-sided printing, and is located on the downstream side of the switching gate G1 in the paper conveying direction. The rollers of the reverse roller pair 251 arranged on the circulation path 24 sandwich and hold the bottom of the paper P conveyed thereto along the circulation path 24, and then reverse the paper P by sending the paper P backward, thereby sending out the reversed paper P to the ADU reverse path 25.

As shown in FIG. 1, the downstream-side end of the ADU reverse path 25 is connected to the image forming path 22. Hence, the paper P sent out to this ADU reverse path 25 returns to the transfer nip part via the registration roller pair 225 by being conveyed by a plurality of conveying units.

The paper P guided to the paper ejector 26 by the switching gate G1 is ejected to the outside of the image forming apparatus 100 by the paper ejector 26. The paper ejector 26 includes: a paper ejection roller pair 261 provided on the downstream side of the switching gate G1; and a paper receiving tray 262 attached to an outer lateral surface of the casing. After passing through the switching gate G1, the paper P is conveyed by the paper ejection roller pair 261 to be ejected to the paper receiving tray 262.

On the downstream side of the paper ejection roller pair 261, not the paper receiving tray 262 but a post-processing apparatus may be provided.

The post-processing apparatus performs post-processing on the paper P conveyed from the image forming apparatus 100, and ejects the paper P. Examples of the post-processing include stapling, punching, folding and binding. The post-processing is not essential and is performed by the post-processing apparatus only when receiving an instruction from the image forming apparatus 100. If the post-processing is not performed, the post-processing apparatus ejects the paper P conveyed thereto as it is.

Figure 2:
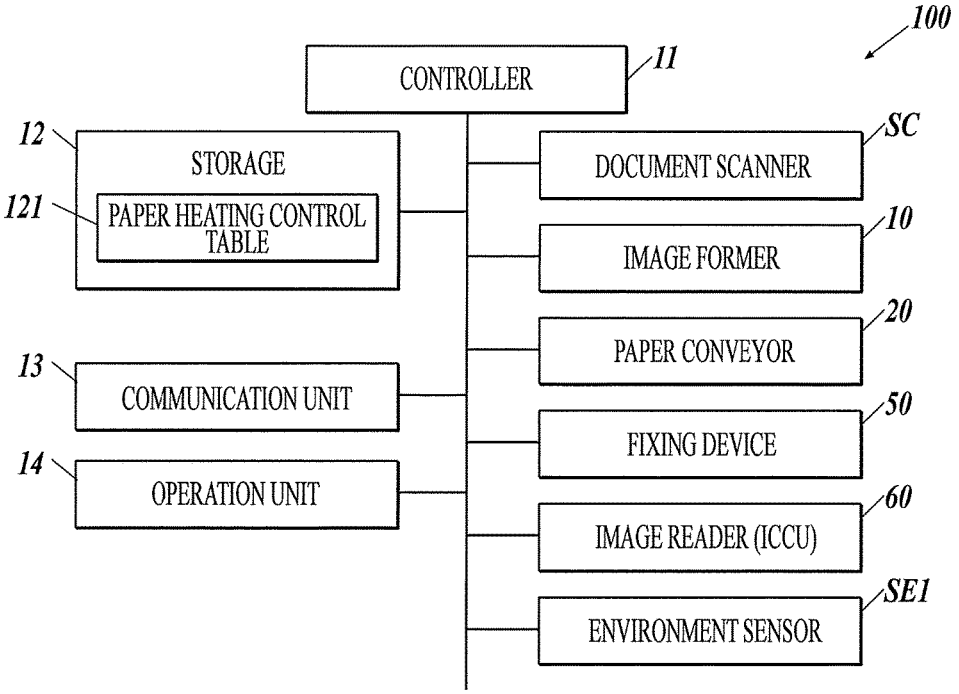
FIG. 2 is a block diagram schematically showing configuration of a control system of the image forming apparatus shown in FIG. 1.

FIG. 2 is a block diagram schematically showing configuration of a control system of the image forming apparatus 100 according to this embodiment.

As shown in FIG. 2, the controller 11 is connected to a storage 12, the communication unit 13, an operation unit 14, the document scanner SC, the image former 10, the paper conveyor 20, the fixing device 50, the image reader 60 and an environment sensor SE1.

The controller 11 includes a CPU (Central Processing Unit, hardware processor) and a RAM (Random Access Memory). The CPU of the controller 11 reads system programs and various process programs stored in the storage 12, loads the read programs to the RAM, and performs centralized control of operations of the components of the image forming apparatus 100 in accordance with the loaded programs. For example, when a job execution instruction is input through the operation unit 14, the controller 11 executes a job and performs control to form a toner image(s) (image forming control) on the paper P on the basis of image data input through the document scanner SC or the communication unit 13. When the job execution instruction is input through the operation unit 14, the controller 11 also performs paper heating control described below.

The storage 12 is constituted of a nonvolatile semiconductor memory, an HDD (Hard Disk Drive) and/or the like, and stores the various programs that are executed by the controller 11, and parameters, data and so forth that are required by the components of the image forming apparatus 100.

For example, the storage 12 stores a paper heating control table 121. The paper heating control table 121 is a table in which paper heating information to determine whether or not to perform preheating control or curl prevention control described below is stored for a predetermined image forming condition(s), such as type, environment and image forming side of the paper P.

The communication unit 13 includes various interfaces, such as an NIC (Network Interface Card), a MODEM (Modulator-DEModulator) and a USB (Universal Serial Bus), and connects the image forming apparatus 100 to external apparatuses.

The operation unit 14 outputs various types of information set by users to the controller 11. As the operation unit 14, for example, a touchscreen through which input operations can be made in accordance with information displayed on its display can be used. Through this operation unit 14, users can set printing conditions (i.e. the image forming conditions), such the type (e.g. basis weight, size, paper quality, etc.) of the paper P, a paper feeding tray to be used, an image density, a magnification ratio, and double-sided printing or not (i.e. single-sided printing). Further, through the operation unit 14, users can input job execution instructions and so forth. The controller 11 controls the operation unit 14 to show various massages to users through the operation unit 14.

The environment sensor SE1 includes, for example, a temperature sensor and/or a humidity sensor, and detects temperature and/or humidity in the casing of the image forming apparatus 100 and outputs the detection result to the controller 11.

[Operation of Image Forming Apparatus 100]

Next, operation of the image forming apparatus 100 according to this embodiment is described.

The image forming apparatus 100 of this embodiment performs the preheating control and the curl prevention control as the paper heating control under the predetermined image forming condition(s).

The preheating control is a process to increase the temperature of the paper P before image forming by making the paper P pass through the fixing device 50, and performs, once or multiple times, operation for conveying the paper P along the circulation path 24, thereby not reversing the paper P, to make the paper P meet the image forming path 22 again without being reversed.

The curl prevention control is a process to increase the temperature of the paper P before image forming by making the paper P pass through the fixing device 50, and performs, once or multiple times, operation for conveying the paper P along the ADU reverse path 25, thereby reversing the paper P, to make the reversed paper P meet the image forming path 22 again.

In normal image forming, the paper P is conveyed along the image forming path 22, and a toner image is formed on the paper P at the transfer nip part and fixed to the paper P by the fixing device 50. If the paper P having a room temperature or around is made to pass through the fixing device 50 having a high temperature (e.g. 180° C. to 200° C.), the heat of the fixing members is absorbed by the paper P, which reduces the fixing temperature. This may cause gloss unevenness in the image.

Hence, the image forming apparatus 100 of this embodiment heats the paper P in advance by the preheating control before image forming on the paper P, thereby suppressing decrease in the temperature of the fixing device 50, and accordingly can ensure fixing properties and prevent gloss unevenness or the like.

Further, the image forming apparatus 100 of this embodiment heats the paper P in advance by the curl prevention control before image forming on the paper P, thereby suppressing decrease in the temperature of the fixing device 50, and accordingly can ensure fixing properties and prevent gloss unevenness or the like.

The paper P may experience a heat curling phenomenon in which moisture on, of the paper P, a side that touches the heated fixing roller 51 evaporates, and the paper P curves toward the fixing roller 51 owing to shrinkage difference between the front side and the back side of the paper P. The curled paper P is wound around the conveying unit(s) or the like provided on the conveyance path. This may cause jams.

Hence, the image forming apparatus 100 of this embodiment curls the paper P in advance by the curl prevention control before image forming on the paper P, and accordingly can obtain a decurler effect by reversing the curled paper P and heating the opposite side of the paper P.

The preheating control and the curl prevention control are performed in accordance with the paper heating information stored in the paper heating control table 121. The paper heating information is information about whether or not to perform the paper heating control (preheating control or curl prevention control) under each image forming condition. The paper heating information is determined for the image forming condition(s), such as the type (basis weight, size, paper quality, etc.), the environment (temperature, humidity, etc.), and the image forming side (single-sided printing or double-sided printing), where image forming is to be performed, of the paper P.

The preheating control is a type of the paper heating control, and is control to preheat the paper P before image forming. For example, if the paper P is one that does not warm up quickly, such as thick paper, the paper P is made to pass through the fixing device 50 before image forming such that the image forming side is heated by the fixing roller 51. Then, the paper P is conveyed along the circulation path 24, thereby not being reversed, to meet the image forming path 22 without being reversed. This makes it possible to heat the image forming side effectively and suppress gloss unevenness or the like.

The curl prevention control is another type of the paper heating control, and is control to heat the paper P and obtain the decurler effect. For example, if the paper P is one that is curled easily by heat, such as thin paper, the paper P is made to pass through the fixing device 50 before image forming so as to be curled in advance. Then, the paper P is reversed by being conveyed along the ADU reverse path 25, and subjected to image forming and made to pass through the fixing device 50 again (the second time). This makes it possible to obtain the decurler effect.

Whether or not to perform the preheating control is described by type of the paper P.

As described above, when the paper P passes through the fixing device 50, the temperature of the fixing members is reduced. That is, there is a difference in the fixing temperature between the first rotation and the subsequent rotation(s) of the fixing belt. Hence, if the paper P is long paper that is longer than the fixing belt in the paper conveying direction, gloss unevenness or the like may occur within the same paper P owing to the difference in the fixing temperature. Therefore, for long paper that is longer than standard-size paper in the paper conveying direction, the preheating control is performed preferably.

If the paper P is one that does not warm up quickly, such as thick paper, the paper P passing through the fixing device 50 once does not increase the temperature of the paper P enough, which may cause poor fixing. Therefore, for thick paper, in order to warm the paper in advance, the preheating control is performed preferably. This can ensure fixing properties. Meanwhile, for paper that warms up quickly and is curled easily, such as thin paper, the curl prevention control is performed preferably.

Whether or not to perform the preheating control may be determined depending on the quality of the paper P or the like.

Next, whether or not to perform the preheating control is described by environment.

Under a high humidity condition, the paper P swells easily by absorbing moisture, but shrinks by heat by passing through the fixing device 50. Image forming is performed before the paper P shrinks. Hence, image deformation may occur owing to shrinkage of the paper P in fixing. This problem can be solved by performing the preheating control on the paper P before image forming so as to shrink the paper P in advance, and then performing image forming and fixing. Therefore, under the high humidity condition, the preheating control is performed preferably.

Whether or not to perform the preheating control may be determined depending on the temperature. For example, under a condition in which the paper P does not warm up quickly, such as low temperature, the preheating control may be performed.

The environment conditions, such as temperature and humidity, in the casing of the image forming apparatus 100 are obtained by the environment sensor SE1.

Next, whether or not to perform the preheating control is described by image forming side.

In single-sided printing, the preheating control is performed, as described above, before image forming. Meanwhile, in double-sided printing, if the preheating control is performed only on one side of the paper P, there will be a difference in the temperature between the first side and the second side of the paper P; in particular, if the paper P is one that does not warm up quickly, such as thick paper, and a sufficient effect cannot be obtained. Therefore, it is preferable that, in double-sided printing, the preheating control be performed before image forming on the first side and before image forming on the second side.

Meanwhile, for paper that warms up quickly, such as thin paper, it is not always necessary to perform the preheating control on both sides. Hence, whether or not to perform the preheating control in double-sided printing may be determined depending on the type of the paper P.

Next, whether or not to perform the curl prevention control is described by type of the paper P.

As described above, when the paper P passes through the fixing device 50, the temperature of the fixing members is reduced. That is, there is a difference in the fixing temperature between the first rotation and the subsequent rotation(s) of the fixing belt. Hence, if the paper P is long paper that is longer than the fixing belt in the paper conveying direction, gloss unevenness or the like may occur within the same paper P owing to the difference in the fixing temperature. Therefore, for long paper that is longer than standard-size paper in the paper conveying direction, the curl prevention control is performed preferably.

Heat curling is more likely to occur to paper having low rigidity, such as thin paper, than paper having high rigidity, which as thick paper. Hence, for thin paper, in order to control the amount of curling, the curl prevention control is performed preferably. Meanwhile, for paper that does not warm up quickly, such as thick paper, not the curl prevention control to heat the opposite side to the image forming side but the preheating control to heat the image forming side is performed preferably.

Whether or not to perform the curl prevention control may be determined depending on the quality of the paper P or the like.

Next, whether or not to perform the curl prevention control is described by environment.

Under a high humidity condition, the paper P swells easily by absorbing moisture, but shrinks by heat by passing through the fixing device 50. Image forming is performed before the paper P shrinks. Hence, image deformation may occur owing to shrinkage of the paper P in fixing. Further, because, under the high humidity condition, the shrinkage difference between the front side and the back side of the paper P generated by the paper P passing through the fixing device 50 is large, heat curling tends to be larger than that under a low humidity condition. Therefore, under the high humidity condition, in order to suppress image deformation and heat curling, the curl prevention control is performed preferably.

Whether or not to perform the curl prevention control may be determined depending on the temperature. For example, under the condition in which the paper P does not warm up quickly, such as low temperature, the curl prevention control may be performed to preheat the paper P.

The environment conditions, such as temperature and humidity, in the casing of the image forming apparatus 100 are obtained by the environment sensor SE1.

Next, whether or not to perform the curl prevention control is described by image forming side.

In single-sided printing, the curl prevention control is performed, as described above, before image forming. Meanwhile, in double-sided printing, it is unnecessary to perform the curl prevention control because between image forming on the first side and image forming on the second side, the paper P is reversed.

FIG. 3A and FIG. 3B show examples of the paper heating control table 121.

FIG. 3A shows, as an example, a paper heating control table 121*a* in which the paper heating information under the low humidity condition is stored. In FIG. 3A, "A" represents a paper type of long thick paper, "B" represents a paper type of long thin paper, "C" represents a paper type of standard-size thick paper, and "D" represents a paper type of standard-size thin paper. The long paper may be paper having a length of 600 mm or more in the paper conveying direction, the thick paper may be paper having a basis weight of 200 g or more, and the thin paper may be paper having a basis weight of less than 200 g.

In the paper heating control table 121*a*, "preheating" means that the preheating control is performed before image forming, "curl prevention" means that the curl prevention control is performed before image forming, and "none" means that image forming is performed without the preheating control or the curl prevention control before image forming.

If the paper P is classified as the paper type A, the preheating control is performed to suppress gloss unevenness or the like within the same paper. In double-sided printing, the preheating control is performed on both the first side and the second side to reduce the difference in the temperature between these sides, each of which is the image forming side.

If the paper P is classified as the paper type B, in single-sided printing, the curl prevention control is performed for preheating. In double-sided printing, the preheating control is performed on the first side for preheating, but is not performed on the second side because the paper P warms up quickly. On the first side, not the curl prevention control but the preheating control is performed because the decurler effect can be obtained by reversing the paper P between image forming on the first side and image forming on the second side. Then, by doing so, the number of times that the paper P passes through the fixing device 50 is minimized to suppress decrease in productivity.

If the paper P is classified as the paper type C, the preheating control is performed in both single-sided printing and double-sided printing as with the paper type A.

If the paper P is classified as the paper type D, in single-sided printing, the curl prevention control is performed, but in double-sided printing, neither the preheating control nor the curl prevention control is performed. In double-sided printing, the decurler effect can be obtained by conveying the paper P to and along the ADU reverse path 25 after image forming on the first side.

FIG. 3B shows, as an example, a paper heating control table 121*b* in which the paper heating information under the high humidity condition is stored.

If the paper P is classified as the paper type A, B or C, the same type of the control as that under the low humidity condition is performed. If the paper P is classified as the paper type D, in single-sided printing, the curl prevention control is performed to reduce influence of shrinkage of the paper P, whereas in double-sided printing, the preheating control is performed on the first side.

Although some examples of the paper heating control table 121 are shown in FIG. 3A and FIG. 3B, they are not intended to limit the present invention, and hence, for thin paper, the preheating control may be performed depending on another/other printing condition(s).

Further, for paper that is not classified as either thick paper or thin paper, such as plain paper, too, whether or not to perform the preheating control may be determined.

Further, multiple threshold values may be set for the paper type, the environment condition(s) or the like to increase or decrease the number of times that the paper P is conveyed along the circulation path 24 for the preheating control.

Figure 4:
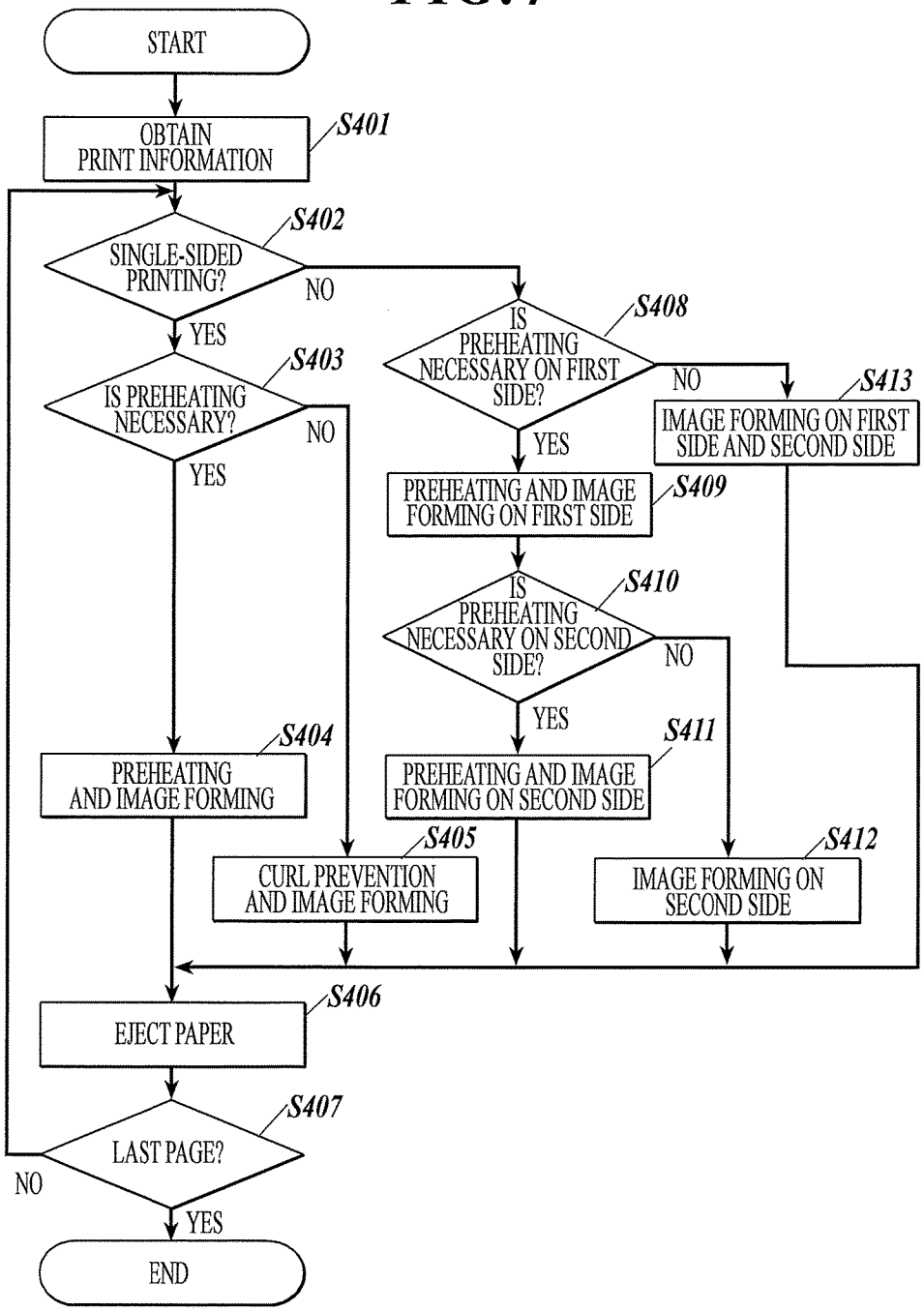
FIG. 4 is a flowchart showing paper heating control that is performed in the first embodiment by a controller.

Next, the paper heating control in the image forming apparatus 100 of the first embodiment is described with reference to a flowchart shown in FIG. 4. The process shown by the flowchart is performed, in response to a job execution instruction from a user, by the controller 11 in cooperation with the program(s) stored in the storage 12 in accordance with the paper heating control table 121 shown in FIG. 3A and FIG. 3B.

When a job is started, the controller 11 obtains print information (Step S401). The print information is information on the printing condition(s), such as the paper type, the environment and the image forming side described above, and the controller 11 extracts: information on the paper type and the image forming side included in the job execution instruction from the user; and information on the environment detected by the environment sensor SE1.

Next, the controller 11 determines whether or not single-sided printing should be performed (Step S402). When determining that single-sided printing should be performed (Step S402: YES), the controller 11 determines whether or not the preheating control is necessary (Step S403). The controller 11 makes the determination in Step S403 with reference to the paper heating information stored in the paper heating control table 121.

When determining that the preheating control is necessary (Step S403: YES), the controller 11 makes the paper P be conveyed along the image forming path 22 and the circulation path 24, thereby performing the preheating control, and makes the paper P be re-conveyed along the image forming path 22, thereby performing image forming (i.e. image forming control) (Step S404). When determining that the preheating control is unnecessary (Step S403: NO), the controller 11 performs the curl prevention control, and also performs image forming (Step S405).

In Step S406, the controller 11 controls the paper ejector 26 to eject the paper P, and then determines whether or not the ejected paper P is the last page (Step S407). When determining that the ejected paper P is the last page (i.e. the last sheet of the job) (Step S407: YES), the controller 11 ends the control. On the other hand, when determining that the ejected paper P is not the last page (Step S407: NO), the controller 11 returns to Step S402.

In Step S402, when determining that single-sided printing should not be performed, namely, double-sided printing should be performed (Step S402: NO), the controller 11 determines whether or not the preheating control is necessary on the first side of the paper P (Step S408). When determining that the preheating control is necessary on the first side (Step S408: YES), the controller 11 performs the preheating control on the first side, and also performs image forming thereon (Step S409).

Next, the controller 11 determines whether or not the preheating control is necessary on the second side of the paper P (Step S410). When determining that the preheating control is necessary on the second side (Step S410: YES), the controller 11 performs the preheating control on the second side, and also performs image forming thereon (Step S411), and proceeds to Step S406. On the other hand, when determining that the preheating control is unnecessary on the second side (Step S410: NO), the controller 11 performs image forming on the second side (Step S412), and proceeds to Step S406.

In Step S408, when determining that the preheating control is unnecessary (Step S408: NO), the controller 11 performs image forming on the first side and the second side of the paper P (Step S413), and proceeds to Step S406.

As described above, the image forming apparatus 100 of the first embodiment includes the circulation path 24 along which the paper P is re-conveyed to the image forming path 22 without being reversed. The controller 11 performs the preheating control to make the paper P pass through the fixing device 50 without image forming, thereby heating the paper P, and re-convey the paper P to the image forming unit 10 via the circulation path 24. This increases the temperature of the paper P before image forming, and hence the heat of the fixing device 50 is less likely to be absorbed by the paper P. This can suppress decrease in the fixing temperature of the fixing device 50, and accordingly can prevent gloss unevenness or the like.

Further, the image forming apparatus 100 of the first embodiment performs the preheating control on the basis of the type of the paper P. Hence, even in the case where gloss unevenness is likely to occur owing to the length (circumference) of the fixing belt, for example, in the case of long paper, glossiness can be made uniform by making the heat of the fixing device 50 not likely to be taken away. Further, for paper that does not warm up quickly, such as thick paper, the preheating control is performed. This can ensure a sufficient level of fixing properties.

Further, the image forming apparatus 100 of the first embodiment performs the preheating control on the basis of the environment. Hence, in the case where shrinkage/change of the paper P is large, for example, in the case of the high humidity condition, the preheating control is performed. This can reduce shrinkage influence on images to be formed.

Further, the image forming apparatus 100 of the first embodiment performs the preheating control on the basis of the image forming side of the paper P. That is, for paper that does not warm up quickly, such as thick paper, in double-sided printing, the preheating control is performed on each of the first side and the second side of the paper P. This can warm both sides of the paper P equally. Hence, both sides of the paper P can receive benefits of the effect(s) of the present invention sufficiently.

Further, because the image forming apparatus 100 of the first embodiment includes the circulation path 24 along which the paper P is re-conveyed to the image forming path 22 without being reversed, it can deal with the fifth color toner, such as a clear toner, in addition to the four color toners of Y, M, C and K toners.

Further, the image forming apparatus 100 of the first embodiment includes the ADU reverse path 25 along which the paper P is reversed and re-conveyed to the image forming path 22. The controller 11 performs the curl prevention control to make the paper P pass through the fixing device 50 without image forming, thereby heating the paper P, and re-convey the paper P to the image forming unit 10 via the ADU reverse path 25. This increases the temperature of the paper P before image forming, and hence the heat of the fixing device 50 is less likely to be absorbed by the paper P. This can suppress decrease in the fixing temperature of the fixing device 50, and accordingly can prevent gloss unevenness or the like.

Further, the image forming apparatus 100 of the first embodiment performs the preheating control on the basis of the type of the paper P. Hence, even in the case where gloss unevenness is likely to occur owing to the length (circumference) of the fixing belt, for example, in the case of long paper, glossiness can be made uniform by making the heat of the fixing device 50 not likely to be taken away. Further, under the condition in which heat curling is likely to occur, like thin paper, the curl prevention control is performed. This can suppress poor conveyance, such as jams.

Further, the image forming apparatus 100 of the first embodiment performs the curl prevention control on the basis of the environment. Hence, in the case where shrinkage/change of the paper P is large, for example, in the case of the high humidity condition, the curl prevention control is performed. This can reduce shrinkage influence on images to be formed.

Further, the image forming apparatus 100 of the first embodiment performs the curl prevention control on the basis of the image forming side of the paper P. That is, in the case where the curl prevention control is performed in single-sided printing, the curl prevention control is not performed in double-sided printing. This is because the paper P is reversed between image forming on the first side and image forming on the second side, and this is utilized for curl correction, and accordingly there is no fear of decrease in productivity.

The image forming apparatus 100 may perform the preheating control or the curl prevention control only on a predetermined number of sheets of the paper P from the start of a job. That is, the image forming apparatus 100 may perform the preheating control or the curl prevention control only until the temperature of the fixing device 50 becomes stable from the start of a job. This can save energy as compared with a case where the preheating control or the curl prevention control is performed on all of the sheets of a job.

Further, if the preheating control is performed, on the assumption that the paper P is made to pass through the fixing device 50 multiple times, the fixing temperature may be lowered. For example, even if the temperature of the fixing device 50 is made 20° C. lower than that in normal image forming, making the paper P pass through the fixing device 50 twice can produce the same level of the effect(s) as the above-described case. In addition, this saves energy.

Second Embodiment

Next, a second embodiment is described.

In the first embodiment, the paper heating control is performed in accordance with the paper heating information stored in the paper heating control table 121, whereas in the second embodiment, the preheating control is repeatedly performed on the same paper until the image forming apparatus 100 reaches a predetermined temperature.

The same components as those of the first embodiment are provided with the same reference numbers as those, and their detailed explanations are not repeated here.

It takes time for the image forming apparatus 100, after starting up, to reach a temperature at which the image forming apparatus 100 can operate. It is desired to shorten this warm-up time as much as possible. Hence, in this embodiment, the preheating control is performed on the same paper P until the image forming apparatus 100 reaches a predetermined temperature. That is, warmed paper P is repeatedly conveyed along the circulation path 24, and accordingly the image forming apparatus 100 is warmed by the heat of the paper P. As a result of that, the warm-up time can be shortened.

Figure 5:
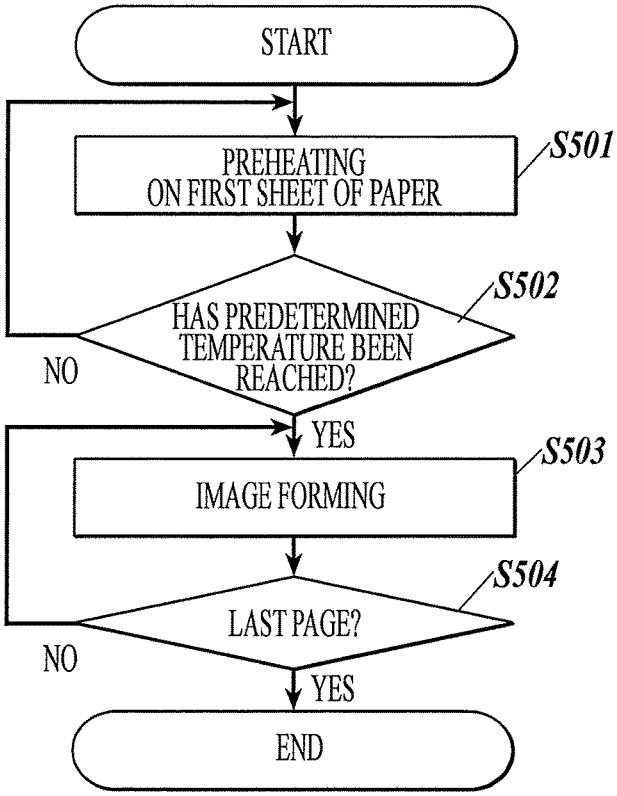
FIG. 5 is a flowchart showing the paper heating control that is performed in a second embodiment by the controller.

Next, the paper heating control that is performed in the second embodiment by the image forming apparatus 100 is described with reference to a flowchart shown in FIG. 5. The process shown by the flowchart is performed by the controller 11 in cooperation with the program(s) stored in the storage 12 in response to a job execution instruction from a user.

When a job is started, the controller 11 performs the preheating control on the first sheet of the paper P stored in the paper feeding tray 211 (Step S501).

Next, the controller 11 determines whether or not the temperature in the casing of the image forming apparatus 100 has reached a predetermined temperature (Step S502). The temperature in the casing of the image forming apparatus 100 is detected by the environment sensor SE1, and the controller 11 obtains the detection result and performs Step S502.

When determining that the temperature has not reached the predetermined temperature yet (Step S502: NO), the controller 11 returns to Step S501 to perform the preheating control on the sheet of the paper P again. On the other hand, when determining that the temperature has reached the predetermined temperature (Step S502: YES), the controller 11 proceeds to Step S503.

In Step S503, the controller 11 performs image forming on the paper P, and determines whether or not the paper P (i.e. the sheet) is the last page (Step S504). When determining that the paper P is the last page (Step S504: YES), the controller 11 ends the control. On the other hand, when determining that the paper P is not the last page (Step S504: NO), the controller 11 returns to Step S503.

As described above, the image forming apparatus 100 of the second embodiment repeatedly performs the preheating control on the same paper (i.e. the same sheet) until the temperature in the casing of the image forming apparatus 100 reaches a predetermined temperature. This repeatedly circulates the heated paper P in the image forming apparatus 100, and accordingly can warm the image forming apparatus 100, which can shorten the heating-up time of the image forming apparatus 100 after its start, thereby shortening the time required before starting a job.

After the temperature in the casing of the image forming apparatus 100 reaches the predetermined temperature, the control in the first embodiment may be performed. This can shorten the warm-up time of the image forming apparatus 100, and also ensure fixing properties of images to the paper P by the preheating control.

Third Embodiment

Next, a third embodiment is described.

In the third embodiment, when a user chooses a low gloss mode, the preheating control is performed.

The same components as those of the first embodiment are provided with the same reference numbers as those, and their detailed explanations are not repeated here.

The low gloss mode is a mode to be chosen by a user when the user desires to reduce glossiness of images to be formed on the paper P. For example, in image forming using matte paper, low gloss images are preferred. The low gloss images are obtained by reducing the fixing temperature.

Hence, in this embodiment, for image forming, a user can choose one of two modes that are a normal image forming mode (first mode) and a low gloss mode (second mode) in which images having lower glossiness (second glossiness) than glossiness (first glossiness) in the normal image forming mode are formed. When the low gloss mode is chosen, the preheating control is performed, which reduces the temperature of the fixing device 50 and thereby reduces glossiness of images to be formed.

Figure 6:
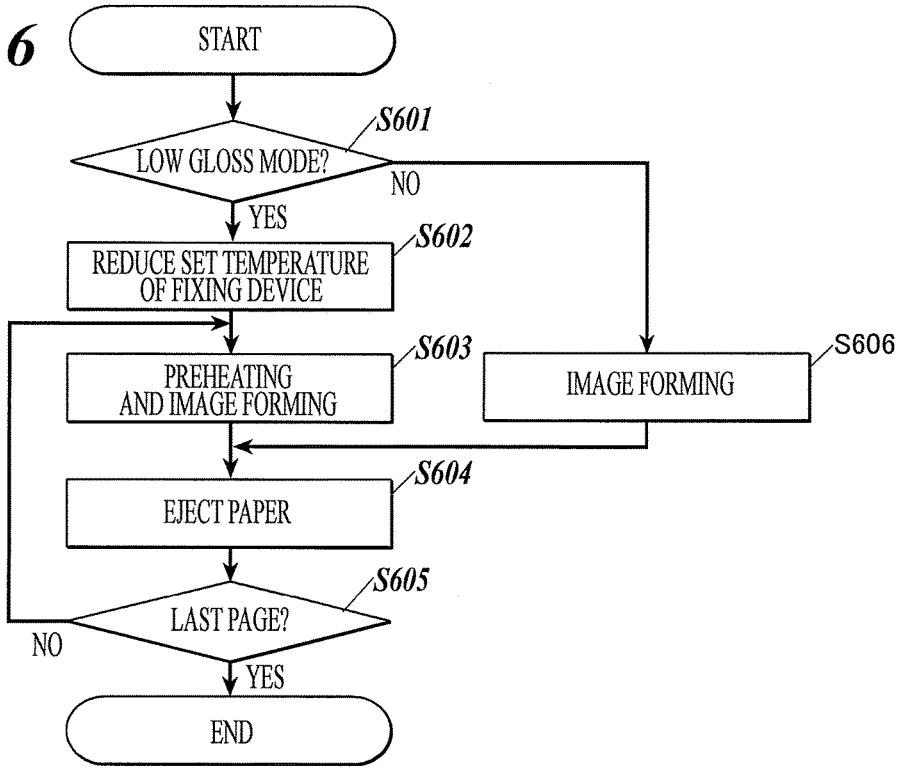
FIG. 6 is a flowchart showing the paper heating control that is performed in a third embodiment by the controller.

Next, the paper heating control that is performed in the third embodiment by the image forming apparatus 100 is described with reference to a flowchart shown in FIG. 6. The process shown by the flowchart is performed by the controller 11 in cooperation with the program(s) stored in the storage 12 in response to a job execution instruction from a user.

When a job is started, the controller 11 determines whether or not the low gloss mode is chosen by a user (Step S601). At the time, the user can choose, through the operation unit 14, one of the low gloss mode and the normal image forming mode, in which images are output with default glossiness.

When determining that the low gloss mode is chosen (Step S601: YES), the controller 11 controls the heater of the fixing device 50 to make the fixing temperature lower than that in the normal image forming mode (Step S602). The fixing temperature (first temperature) in the normal image forming mode and the fixing temperature (second temperature) in the low gloss mode are preset and stored in the storage 12.

Next, the controller 11 makes the paper P be conveyed along the image forming path 22 and the circulation path 24, thereby performing the preheating control, and also makes the paper P be re-conveyed along the image forming path 22, thereby performing image forming (Step S603).

Next, the controller 11 controls the paper ejector 26 to eject the paper P (Step S604), and determines whether or not the ejected paper P is the last page (Step S605). When determining that the ejected paper P is the last page (Step S605: YES), the controller 11 ends the control. On the other hand, when determining that the ejected paper P is not the last page (Step S605: NO), the controller 11 returns to Step S603.

In Step S601, when determining that the low gloss mode is not chosen, namely, the normal image forming mode is chosen (Step S601: NO), the controller 11 performs image forming on the paper P (Step S606), and proceeds to Step S604.

As described above, the image forming apparatus 100 of the third embodiment performs either the normal image forming mode or the low gloss mode, in which images having glossiness lower than that in the normal image forming mode are formed, and in the low gloss mode, makes the fixing temperature of the fixing device 50 lower than that in the normal image forming mode, and performs the preheating control on the paper P.

That is, because the temperature of the paper P is increased in advance by the preheating control, fixing properties can be ensured although the fixing temperature is lower. Reducing the fixing temperature reduces glossiness of images. This can provide users with low gloss images that meet their desires.

When the low gloss mode is not chosen, namely, in the normal image forming mode, the control in the first embodiment may be performed. This can effectively reduce glossiness of images in the low gloss mode, and ensure fixing properties of images to the paper P by the preheating control in the normal image forming mode.

Although the low gloss mode is adopted in the above embodiment, if high glossiness is desired, glossiness of images can be increased by making the paper P pass through the fixing device 50 multiple times after image forming. That is, glossiness of images can be controlled by, after image forming, conveying the paper P along the circulation path 24, thereby not reversing the paper P, and making the paper P pass through the fixing device 50 multiple times without being reversed.

If the paper P is long paper, image quality on each side is demanded, in particular. For such a case, it is effective to control glossiness from low glossiness to high glossiness by making the paper P pass through the fixing device 50 multiple times at the lowest possible temperature.

Fourth Embodiment

Next, a fourth embodiment is described.

In the first embodiment, the paper heating control is performed in accordance with the paper heating information stored in the paper heating control table 121, whereas in the fourth embodiment, the curl prevention control is repeatedly performed on the same paper until the image forming apparatus 100 reaches a predetermined temperature.

The same components as those of the first embodiment are provided with the same reference numbers as those, and their detailed explanations are not repeated here.

It takes time for the image forming apparatus 100, after starting up, to reach a temperature at which the image forming apparatus 100 can operate. It is desired to shorten this warm-up time as much as possible. Hence, in this embodiment, the curl prevention control is performed on the same paper P until the image forming apparatus 100 reaches a predetermined temperature. That is, warmed paper P is repeatedly conveyed along the ADU reverse path 25, and accordingly the image forming apparatus 100 is warmed by the heat of the paper P. As a result of that, the warm-up time can be shortened.

Figure 7:
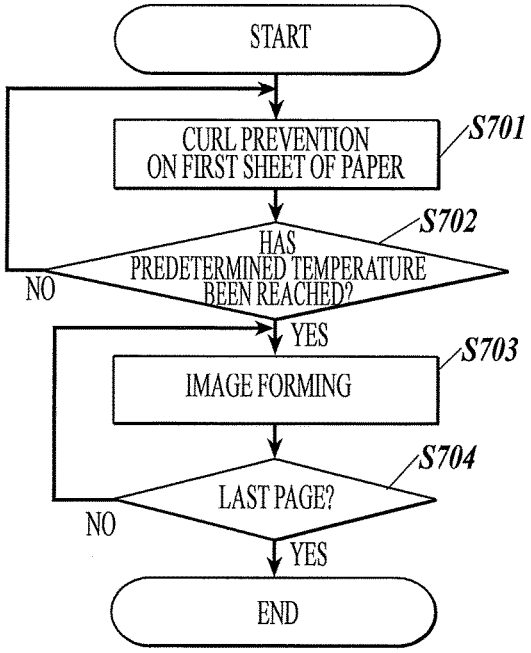
FIG. 7 is a flowchart showing the paper heating control that is performed in a fourth embodiment by the controller.

Next, the paper heating control that is performed in the fourth embodiment by the image forming apparatus 100 is described with reference to a flowchart shown in FIG. 7. The process shown by the flowchart is performed by the controller 11 in cooperation with the program(s) stored in the storage 12 in response to a job execution instruction from a user.

When a job is started, the controller 11 performs the curl prevention control on the first sheet of the paper P stored in the paper feeding tray 211 (Step S701).

Next, the controller 11 determines whether or not the temperature in the casing of the image forming apparatus 100 has reached a predetermined temperature (Step S702). The temperature in the casing of the image forming apparatus 100 is detected by the environment sensor SE1, and the controller 11 obtains the detection result and performs Step S702.

When determining that the temperature has not reached the predetermined temperature yet (Step S702: NO), the controller 11 returns to Step S701 to perform the curl prevention control on the sheet of the paper P again. On the other hand, when determining that the temperature has reached the predetermined temperature (Step S702: YES), the controller 11 proceeds to Step S703.

In Step S703, the controller 11 performs image forming on the paper P and determines whether or not the paper P (i.e. the sheet) is the last page (Step S704). When determining that the paper P is the last page (Step S704: YES), the controller 11 ends the control. On the other hand, when determining that the paper P is not the last page (Step S704: NO), the controller 11 returns to Step S703.

As described above, the image forming apparatus 100 of the fourth embodiment repeatedly performs the curl prevention control on the same paper (i.e. the same sheet) until the temperature in the casing of the image forming apparatus 100 reaches a predetermined temperature. This repeatedly circulates the heated paper P in the image forming apparatus 100, and accordingly can warm the image forming apparatus 100, which can shorten the heating-up time of the image forming apparatus 100 after its start, thereby shortening the time required before starting a job.

After the temperature in the casing of the image forming apparatus 100 reaches the predetermined temperature, the control in the first embodiment may be performed. This can shorten the warm-up time of the image forming apparatus 100, and also ensure fixing properties of images to the paper P by the curl prevention control.

Fifth Embodiment

Next, a fifth embodiment is described.

In the fifth embodiment, when a user chooses a low gloss mode, the curl prevention control is performed.

The same components as those of the first embodiment are provided with the same reference numbers as those, and their detailed explanations are not repeated here.

The low gloss mode is a mode to be chosen by a user when the user desires to reduce glossiness of images to be formed on the paper P. For example, in image forming using matte paper, low gloss images are preferred. The low gloss images are obtained by reducing the fixing temperature.

Hence, in this embodiment, for image forming, a user can choose one of two modes that are a normal image forming mode (first mode) and a low gloss mode (second mode) in which images having lower glossiness (second glossiness) than glossiness (first glossiness) in the normal image forming mode are formed. When the low gloss mode is chosen, the curl prevention control is performed, which reduces the temperature of the fixing device 50 and thereby reduces glossiness of images to be formed.

Figure 8:
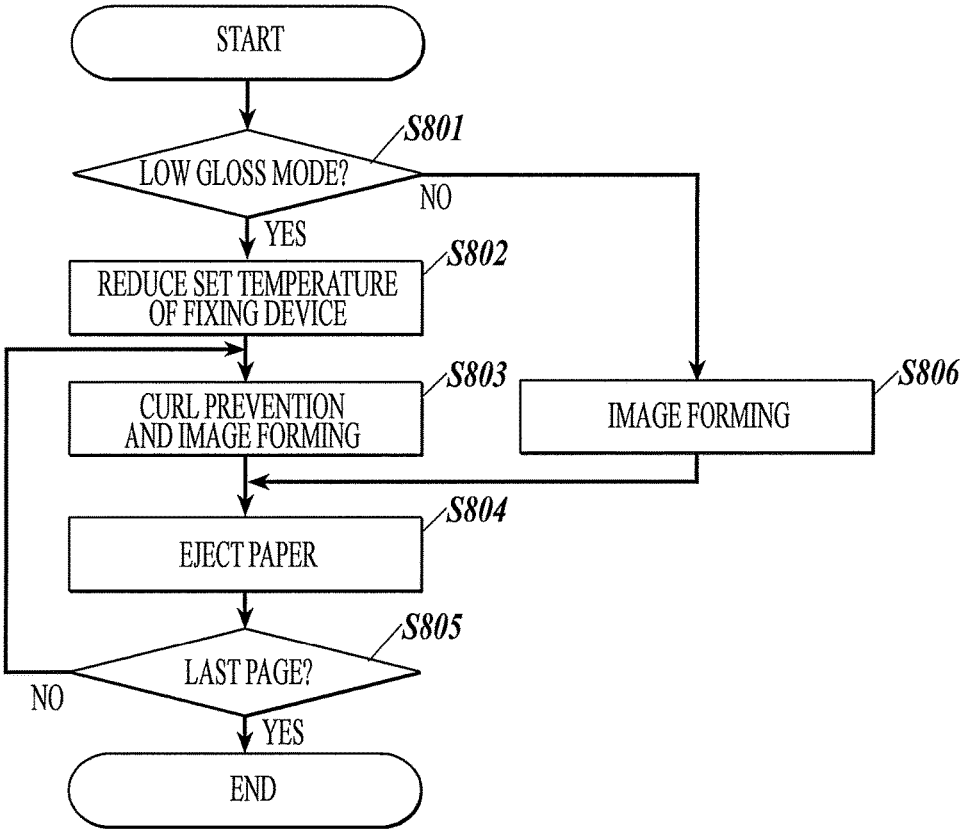
FIG. 8 is a flowchart showing the paper heating control that is performed in a fifth embodiment by the controller.

Next, the paper heating control that is performed in the fifth embodiment by the image forming apparatus 100 is described with reference to a flowchart shown in FIG. 8. The process shown by the flowchart is performed by the controller 11 in cooperation with the program(s) stored in the storage 12 in response to a job execution instruction from a user.

When a job is started, the controller 11 determines whether or not the low gloss mode is chosen by a user (Step S801). At the time, the user can choose, through the operation unit 14, one of the low gloss mode and the normal image forming mode, in which images are output with default glossiness.

When determining that the low gloss mode is chosen (Step S801: YES), the controller 11 controls the heater of the fixing device 50 to make the fixing temperature lower than that in the normal image forming mode (Step S802). The fixing temperature (first temperature) in the normal image forming mode and the fixing temperature (second temperature) in the low gloss mode are preset and stored in the storage 12.

Next, the controller 11 makes the paper P be conveyed along the image forming path 22 and the ADU reverse path 25, thereby performing the curl prevention control, and also makes the paper P be re-conveyed along the image forming path 22, thereby performing image forming (Step S803).

Next, the controller 11 controls the paper ejector 26 to eject the paper P (Step S804), and determines whether or not the ejected paper P is the last page (Step S805). When determining that the ejected paper P is the last page (Step S805: YES), the controller 11 ends the control. On the other hand, when determining that the ejected paper P is not the last page (Step S805: NO), the controller 11 returns to Step S803.

In Step S801, when determining that the low gloss mode is not chosen, namely, the normal image forming mode is chosen (Step S801: NO), the controller 11 performs image forming on the paper P (Step S806), and proceeds to Step S804.

As described above, the image forming apparatus 100 of the fifth embodiment performs either the normal image forming mode or the low gloss mode, in which images having glossiness lower than that in the normal image forming mode are formed, and in the low gloss mode, makes the fixing temperature of the fixing device 50 lower than that in the normal image forming mode, and performs the curl prevention control on the paper P.

That is, because the temperature of the paper P is increased in advance by the curl prevention control, fixing properties can be ensured although the fixing temperature is lower. Reducing the fixing temperature reduces glossiness of images. This can provide users with low gloss images that meet their desires.

When the low gloss mode is not chosen, namely, in the normal image forming mode, the control in the first embodiment may be performed. This can effectively reduce glossiness of images in the low gloss mode, and ensure fixing properties of images to the paper P by the curl prevention control in the normal image forming mode.

Although the low gloss mode is adopted in the above embodiment, if high glossiness is desired, glossiness of images can be increased by making the paper P pass through the fixing device 50 multiple times after image forming. That is, glossiness of images can be controlled by, after image forming, conveying the paper P along the circulation path 24, thereby not reversing the paper P, and making the paper P pass through the fixing device 50 multiple times without being reversed.

If the paper P is long paper, image quality on each side is demanded, in particular. For such a case, it is effective to control glossiness from low glossiness to high glossiness by making the paper P pass through the fixing device 50 multiple times at the lowest possible temperature.

Sixth Embodiment

Next, a sixth embodiment is described.

The same components as those of the first embodiment are provided with the same reference numbers as those, and their detailed explanations are not repeated here.

Figure 9:
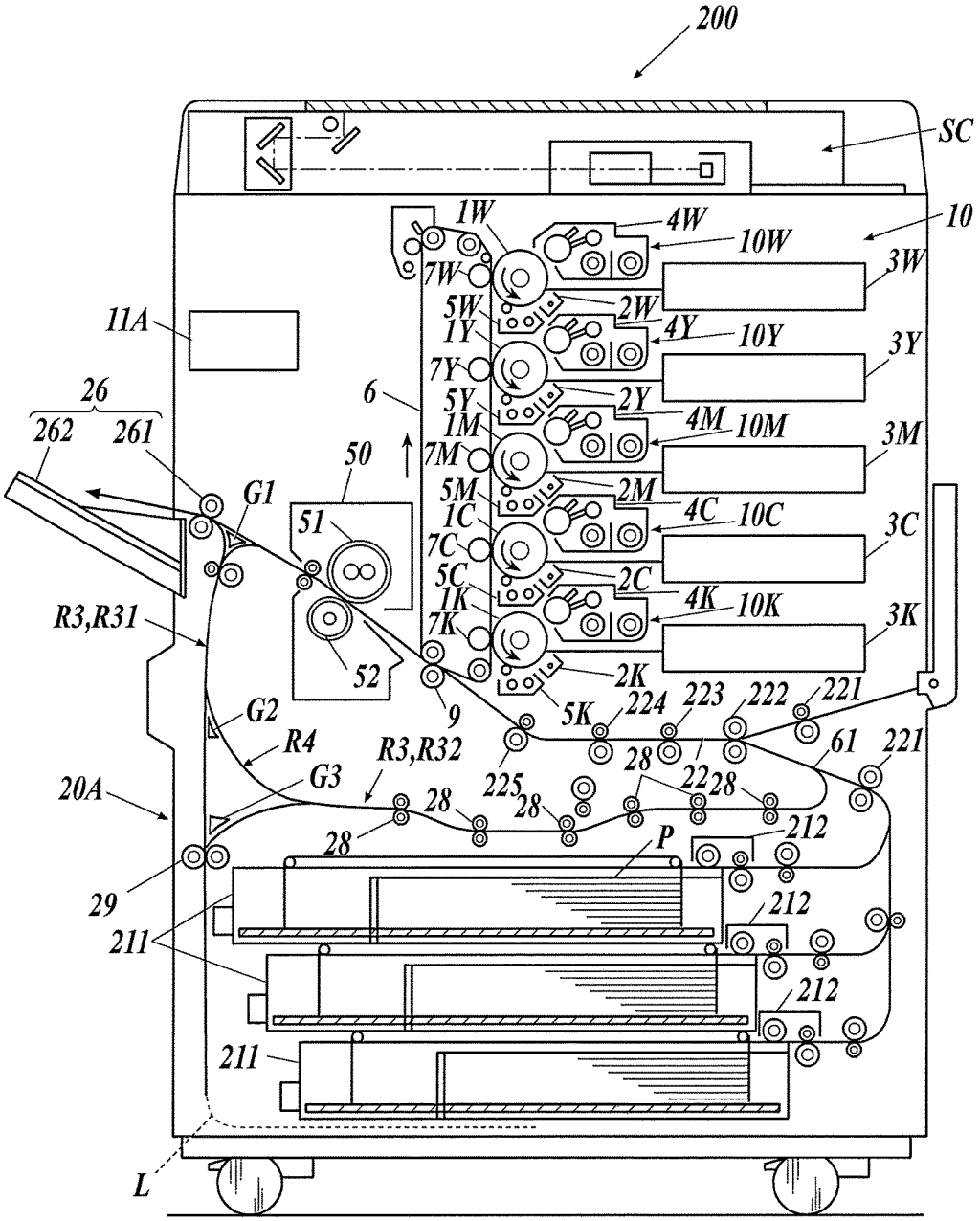
FIG. 9 schematically shows configuration of an image forming apparatus according to a sixth embodiment.

FIG. 9 schematically shows an image forming apparatus 200 according to this embodiment.

The image forming apparatus 200 includes the document scanner SC, the image former 10, the fixing device 50, the image reader 60 and a controller 11A as main components, and these components are housed in one casing.

The image former 10 includes the four image forming units 10Y, 10M, 10C, 10K of standard colors (process colors), one image forming unit 10W of a spot color, the intermediate transfer belt 6, and the secondary transfer roller pair 9.

The image forming unit 10W forms white (W) images.

As with the image forming unit 10Y and so forth, the image forming unit 10W includes: a photoconductive drum 1W; and a charger 2W, an optical writer 3W, a developing device 4W and a drum cleaner 5W arranged around the photoconductive drum 1W.

A paper conveyor 20A conveys the paper P along the paper conveyance path of the paper P. The paper conveyor 20A includes the paper feeder 21, the image forming path 22, the switching gate G1, a circulation path R3 and the paper ejector 26.

A sending-forward/backward section R31 (described below) of the circulation path R3 is provided with a switching gate G2 and a switching gate G3.

The circulation path R3 of this embodiment has the sending-forward/backward section R31 to reverse the paper P, a paper refeeding section R32 to convey, to the image forming path 22, the paper P reversed along the sending-forward/backward section R31, and a shortcut path R4.

Thus, the circulation path R3 functions as a reverse path to reverse the paper P having been subjected to the fixing process by the fixing device 50, and make the reversed paper P meet the image forming path 22.

The sending-forward/backward section R31 is arranged to diverge from the image forming path 22 at the position of the switching gate G1 on the image forming path 22 to extend downward.

This sending-forward/backward section R31 is provided with the switching gate G2, the switching gate G3 and a reverse roller pair 29 arranged in this order from the upstream side to the downstream side in the paper conveying direction (from the upper side to the lower side in the apparatus).

To reverse the paper P and make the reversed paper P meet the image forming path 22, the paper P conveyed from the image forming path 22 is sent forward until its bottom reaches the reverse roll pair 29 (predetermined position), and starts being sent backward by the reverse roller pair 29 rotating in the opposite direction at the timing at which the rollers of the reverse roller pair 29 sandwich and holds the bottom of the paper P. The paper P being sent backward runs to the paper refeeding section R32 from its bottom by being guided by the switching gate G3.

On the assumption that long paper which is longer in the conveying-direction length than standard-size paper is used as the paper P, preferably, the sending-forward/backward section R31 may be provided to reach near the bottom of the image forming apparatus 200 as indicated by a broken line L.

The paper refeeding section R32 is arranged to diverge from the sending-forward/backward section R31 at the position of the switching gate G3 on the sending-forward/backward section R31 and reach a meeting point 61 provided on the image forming path 22.

This paper refeeding section R32 is provided with intermediate conveying roller pairs 28 as the conveying units from the upstream side to the downstream side in the paper conveying direction. The intermediate conveying roller pairs 28 are arranged at intervals shorter than the length of the minimum paper P in the paper conveying direction, the minimum paper P passing through the image forming apparatus 200.

The paper P sent backward on the sending-forward/backward section R31 is conveyed along the paper refeeding section R32 from its bottom, and on the image forming path 22, reaches the meeting point 61 provided on the upstream side of the image former 10 in the paper conveying direction. The paper P having reached the meeting point 61 is sent out to the image forming path 22 again.

The shortcut path R4 is a conveyance path that is used to make the paper P having been subjected to the fixing process by the fixing device 50 meet the image forming path 22 without being reversed (without the image forming side being changed).

The shortcut path R4 is arranged to diverge from the sending-forward/backward section R31 of the circulation path R3 at the position of the switching gate G2 on the sending-forward/backward section R31 and reach the paper refeeding section R32.

To make the paper P meet the image forming path 22 without being reversed, the paper P conveyed from the image forming path 22 runs to the shortcut path R4 by being guided by the switching gate G2, thereby not reaching the switching gate G3 or the reverse roller pair 29, and is conveyed along the shortcut path R4 to the paper refeeding section R32.

The paper P having reached the paper refeeding section R32 by being conveyed along the shortcut path R4 is conveyed along the paper refeeding section R32, and sent out to the image forming path 22 again via the meeting point 61 provided on the image forming path 22.

The switching gate G1 is provided on the downstream side of the fixing device 50 in the paper conveying direction, and switches the path for the paper P to be conveyed, the paper P having been conveyed to the switching gate G1 along the image forming path 22. That is, if the paper P having passed through the fixing device 50 is conveyed to the circulation path R3, the switching gate G1 guides the paper P downward, whereas if the paper P is ejected by the paper ejector 26, the switching gate G1 makes the paper P go straight.

The switching gate G1 is, as a default, in a state of sending the paper P to the paper ejector 26. When sending the paper P to the circulation path R3, the switching gate G1 is driven by a not-shown drive unit and conveys the paper P downward, and then returns to the default state.

The switching gate G2 is provided on the sending-forward/backward section R31 of the circulation path R3, and switches the destination of the paper P guided downward by the switching gate G1. More specifically, if the paper P is reversed, the switching gate G2 guides the paper P downward, whereas if the paper P is not reversed, that is, is conveyed to the shortcut path R4, the switching gate G2 guides the paper P diagonally downward right in FIG. 9.

The switching gate G2 is, as a default, in a state of sending the paper P downward. When sending the paper P to the shortcut path R4, the switching gate G2 is driven by a not-shown drive unit and conveys the paper P diagonally downward right, and then returns to the default state.

The switching gate G3 is provided on the sending-forward/backward section R31 on the downstream side of the switching gate G2 in the paper conveying direction, and switches the destination of the paper P that may be sent backward along the sending-forward/backward section R31. More specifically, if the paper P is sent backward along the sending-forward/backward section R31 to be conveyed to the paper refeeding section R32, the switching gate G3 guides the paper P diagonally upward right in FIG. 9, whereas if the paper P, which has been conveyed from the image forming path 22, is sent forward, the switching gate G3 guides the paper P downward.

The switching gate G3 is, as a default, in a state of guiding the paper P downward (in a state of sending the paper P forward). When conveying the paper P to the paper refeeding section R32 (sending the paper P backward), the switching gate G3 is driven by a not-shown drive unit and conveys the paper P diagonally upward right, and then returns to the default state.

A controller 11A is, like the first embodiment, connected to the storage 12, the communication unit 13, the operation unit 14, the document scanner SC, the image former 10, the paper conveyor 20A, the fixing device 50 and the image reader 60, for example.

The controller 11A includes a CPU and a RAM. The CPU of the controller 11A reads system programs and various process programs stored in the storage 12, loads the read programs to the RAM, and performs centralized control of operations of the components of the image forming apparatus 200 in accordance with the loaded programs.

For example, when a job execution instruction is input through the operation unit 14, the controller 11A executes a job and performs control to form a toner image(s) on the paper P on the basis of image data input through the document scanner SC or the communication unit 13.

In this embodiment, the controller 11A can perform an overwriting process of circulating, without reversing, the paper P having an image(s) formed by the image former 10, and causing the image former 10 to form an image(s) on the same image forming side of the paper P.

[Operation of Image Forming Apparatus 200]

Next, operation of the image forming apparatus 200 of this embodiment is described.

Figure 10:
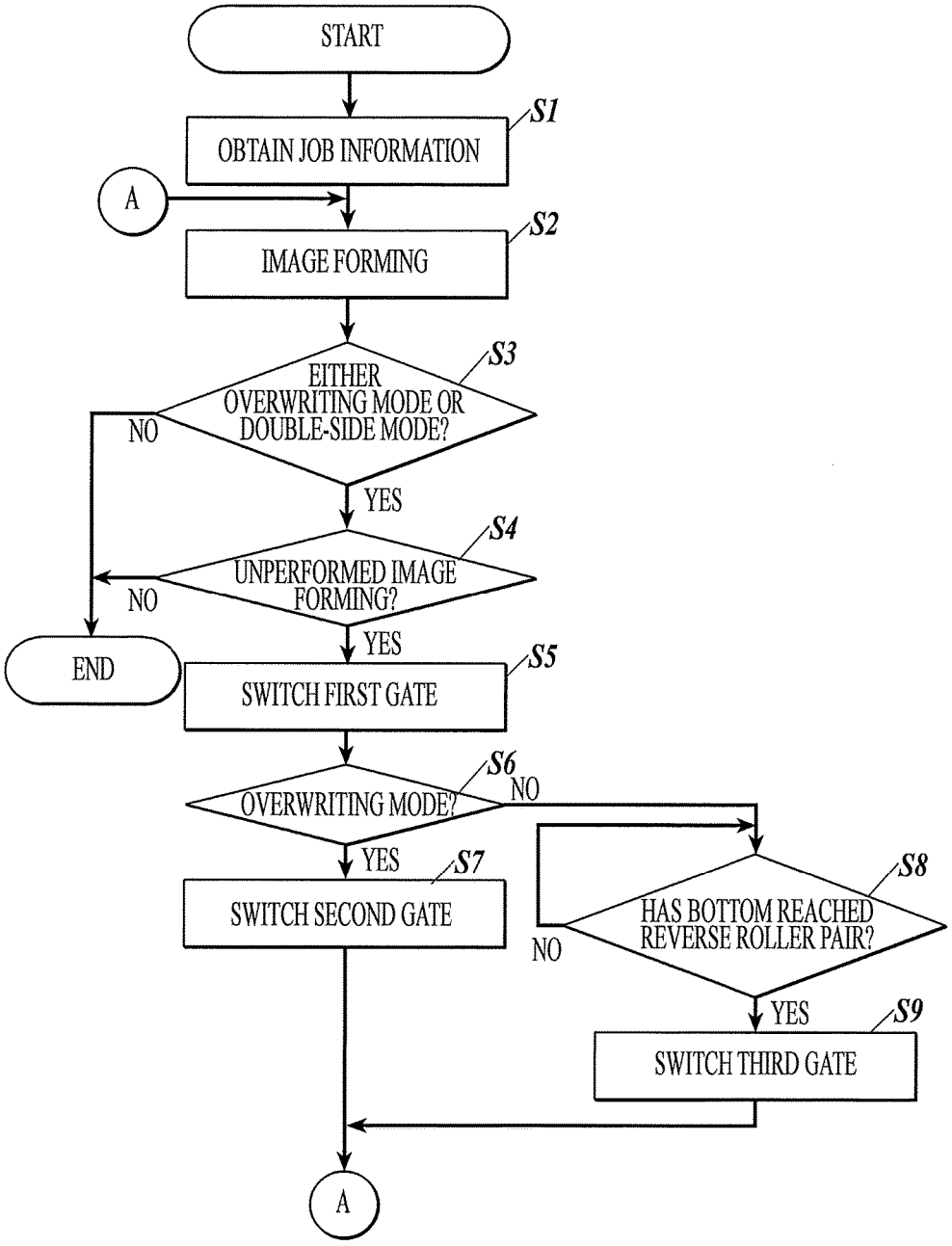
FIG. 10 is a flowchart showing an image forming process that is performed in the sixth embodiment by a controller.

FIG. 10 is a flowchart showing an image forming process that is performed by the image forming apparatus 200. The process shown by the flowchart is performed by the controller 11A in cooperation with the program(s) stored in the storage 12 in response to a job execution instruction from a user.

First, the controller 11A obtains, via the communication unit 13, job information sent from an external apparatus (Step S1).

The job information includes various types of information on the image forming process, such as mode information and image data of images to be formed.

As the mode information, one of a normal mode, a double-side mode and an overwriting mode is set. The normal mode is a mode of performing image forming on one side of the paper P once. The double-side mode is a mode of performing image forming on both sides of the paper P. The overwriting mode is a mode of performing image forming on one side of the paper P multiple times.

The image data includes one or more image data according to the image forming mode (the normal mode, the double-side mode or the overwriting mode), and information is added thereto. Examples of the information include information about which side, namely, the front side or the back side, of the paper P, the image(s) is to be formed, and information about by which image forming, for example, the first image forming, the second image forming or the like, the image(s) is to be formed.

Next, the controller 11A causes the image former 10 to perform the top-priority image forming among unperformed image forming(s) (Step S2).

For example, in the normal mode, the controller 11A causes the image former 10 to form an image (perform image forming) on one side (front side) of the paper P.

In the overwriting mode, if the first image forming (i.e. image forming to be performed first) is unperformed, the controller 11A causes the image former 10 to perform the first image forming, whereas if the first image forming has been performed, but the second image forming (i.e. image forming to be performed second) is unperformed, the controller 11A causes the image former 10 to perform the second image forming.

In the double-side mode, if image forming on the front side is unperformed, the controller 11A causes the image former 10 to perform image forming on the front side, whereas if image forming on the front side has been performed, but image forming on the back side is unperformed, the controller 11A causes the image former 10 to perform image forming on the back side.

Next, the controller 11A determines whether or not either the overwriting mode or the double-side mode is set (Step S3). When determining that neither of them is set (the normal mode is set) (Step S3: NO), the controller 11A ends the image forming process.

On the other hand, when determining that either the overwriting mode or the double-side mode is set (Step S3: YES), the controller 11A determines whether or not there is any unperformed image forming (Step S4). When determining that there is no unperformed image forming (Step S4: NO), the controller 11A ends the image forming process.

On the other hand, when determining that there is unperformed image forming (Step S4: YES), the controller 11A switches the switching gate G1 to convey the paper P to the sending-forward/backward section R31 of the circulation path R3 (Step S5).

Next, the controller 11A determines whether or not the overwriting mode is set (Step S6). When determining that the overwriting mode is set (Step S6: YES), the controller 11A switches the switching gate G2 (Step S7), and then proceeds to Step S2 to repeat Step S2 and the subsequent step(s).

Thus, the paper P is conveyed to the paper refeeding section R32 via the shortcut path R4, meets the image forming path 22 by being conveyed along the paper refeeding section R32, and reaches the image former 10.

On the other hand, when determining that the overwriting mode is not set (Step S6: NO), the controller 11A determines whether or not the bottom of the paper P has reached the reverse roller pair 29 (Step S8). When determining that the bottom of the paper P has not reached the reverse roller pair 29 yet (Step S8: NO), the controller 11A repeats Step S8.

On the other hand, when determining that the bottom of the paper P has reached the reverse roller pair 29 (Step S8: YES), the controller 11A switches the switching gate G3 (Step S9), and then proceeds to Step S2 to repeat Step S2 and the subsequent step(s).

Thus, the paper P is sent backward to be conveyed to the paper refeeding section R32, meets the image forming path 22 by being conveyed along the paper refeeding section R32, and reaches the image former 10.

As described above, according to the image forming apparatus 200 of the sixth embodiment, the circulation path R3 includes: the sending-forward/backward section R31 that diverges from the image forming path 22 on the downstream side of the fixing device 50 in the paper conveying direction so as to send the paper P backward after sending the paper P forward until the bottom of the paper P reaches a predetermined position; and the paper refeeding section R32 that makes the paper P meet the image forming path 22 on the upstream side of the image former 10 in the paper conveying direction, the paper P being sent backward along the sending-forward/backward section R31.

Thus, having the sending-forward/backward section R31 can reverse the paper P having been subjected to the fixing process by the fixing device 50.

Further, according to the image forming apparatus 200 of the sixth embodiment, the circulation path R3 includes the shortcut path R4 that diverges from the sending-forward/backward section R31 on the upstream side of the predetermined position in the paper conveying direction so as to convey the paper P to the paper refeeding section R32 without sending the paper P backward.

Thus, by making the paper P on the sending-forward/backward section R31 run to the paper refeeding section R32 via the shortcut path R4, the paper P can meet the image former 10 without being reversed.

That is, the paper P can pass through the image former 10 multiple times without being reversed.

Further, the image forming apparatus 200 of the sixth embodiment includes: the switching gate G1 that switches the destination of the paper P on the image forming path 22 to the sending-forward/backward section R31; and the switching gates G2 and G3 on the sending-forward/backward section R31 arranged in this order from the upstream side to the downstream side in the paper conveying direction, wherein the switching gate G2 switches the destination of the paper P being sent forward on the sending-forward/backward section R31 to the shortcut path R4, and the switching gate G3 switches the destination of the paper P on the sending-forward/backward section R31 to the paper refeeding section R32, thereby sending the paper P backward.

Thus, before the paper P on the sending-forward/backward section R31 is reversed, the paper P can be made to run to the paper refeeding section R32 via the shortcut path R4.

Further, the image forming apparatus 200 of this embodiment includes the controller 11A that performs the process of conveying the paper P to the paper refeeding section R32 via the shortcut path R4, thereby making the paper P pass through the image former 10 multiple times such that the image forming side of the paper P is unchanged (remains the same side).

This makes it possible, for example, to form images on the same side of the paper P on top of one another.

Seventh Embodiment

Next, a seventh embodiment is described.

The same components as those of the first embodiment are provided with the same reference numbers as those, and their detailed explanations are not repeated here.

Figure 11:
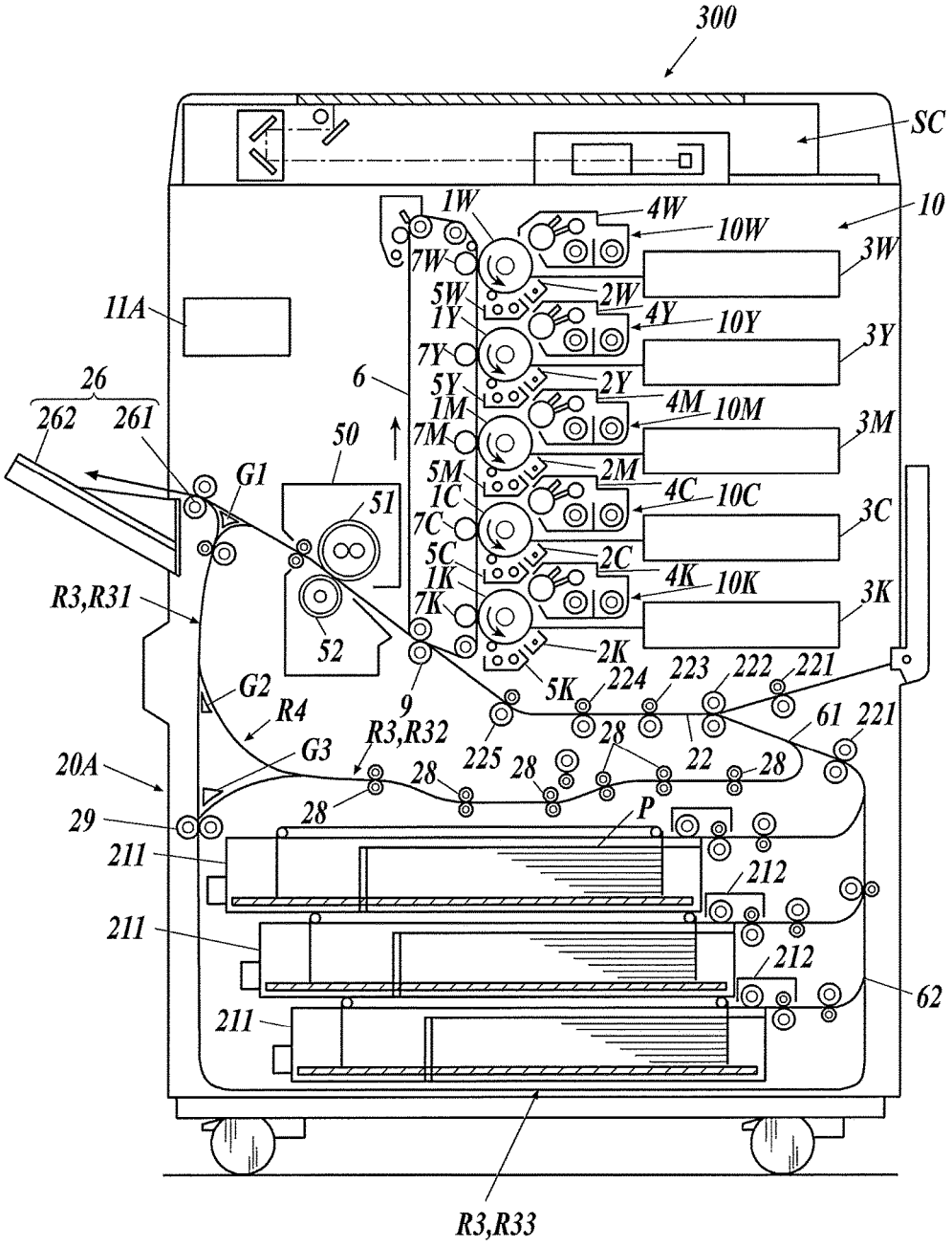
FIG. 11 schematically shows configuration of an image forming apparatus according to a seventh embodiment.

FIG. 11 schematically shows an image forming apparatus 300 according to this embodiment.

As shown in FIG. 11, in the image forming apparatus 300, the circulation path R3 includes a second paper refeeding section R33 in addition to the sending-forward/backward section R31, the paper refeeding section R32 and the shortcut path R4.

The second paper refeeding section R33 is arranged to be continuous with the downstream-side end of the sending-forward/backward section R31 in the paper conveying direction and reach a meeting point 62 provided on the image forming path 22.

Further, the second paper refeeding section R33 is arranged under the paper feeding trays 211, namely, such that the paper P runs near the bottom of the image forming apparatus 300.

This second paper refeeding section R33 can be used to circulate the paper P that is long in the paper conveying direction than standard-size paper, for example.

Such long paper P can be sent out to the image forming path 22 from a paper feeding apparatus (not shown) connected to the image forming apparatus 300 or a bypass tray attached to the image forming apparatus 300, for example.

Hereinafter, operation of the image forming apparatus 300 is described.

Figure 12:
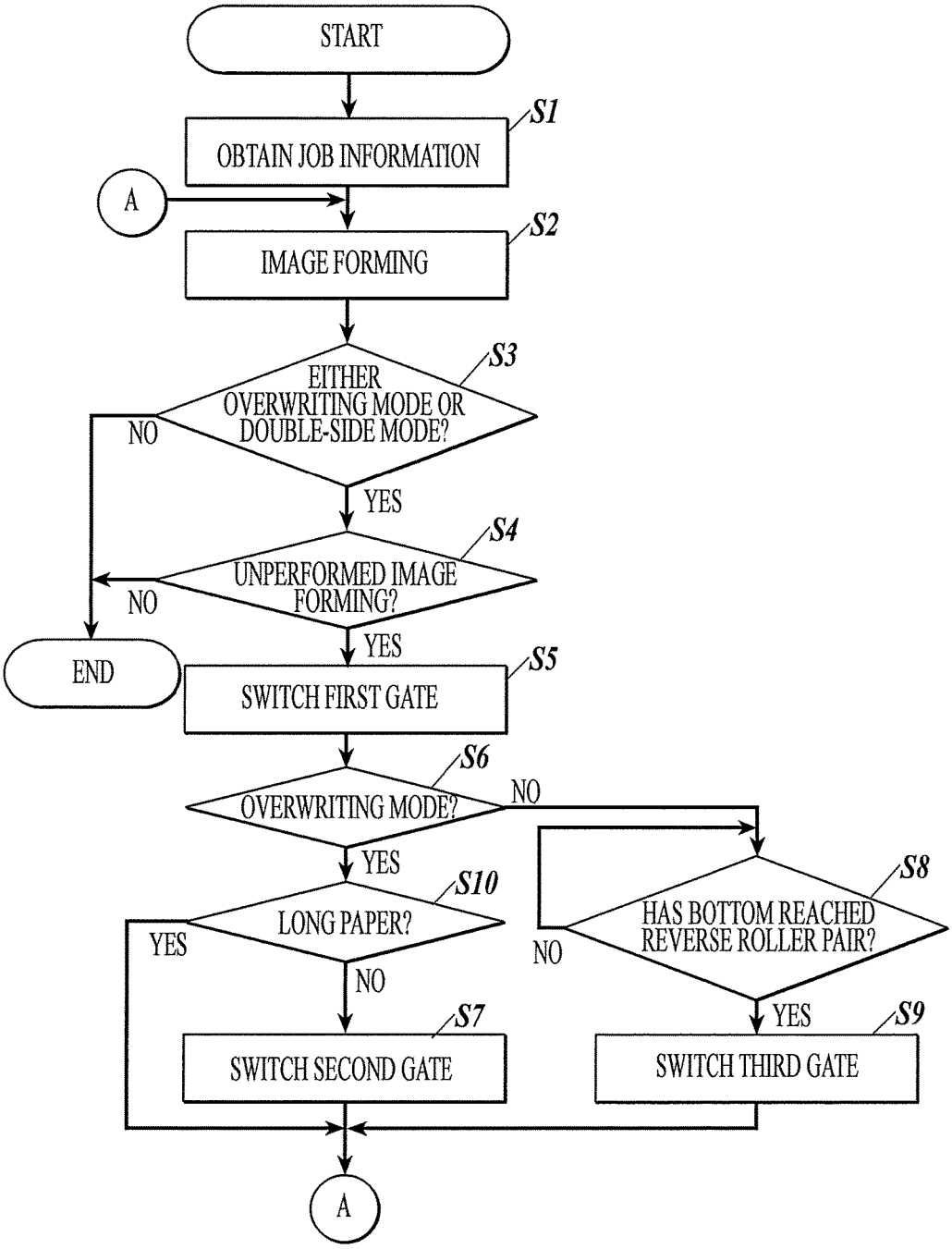
FIG. 12 is a flowchart showing the image forming process that is performed in the seventh embodiment by the controller.

FIG. 12 is a flowchart showing the image forming process that is performed by the image forming apparatus 300. The same steps as those of the image forming process shown in FIG. 10 are provided with the same numbers as those, and their detailed explanations are not repeated here.

As shown in FIG. 12, the controller 11A performs Steps S1 to S6 that are the same as those of the image forming process shown in FIG. 10.

In Step S6, when determining that the overwriting mode is set (Step S6: YES), the controller 11A determines whether or not the paper P is long paper (Step S10). When determining that the paper P is long paper (Step S10: YES), the controller 11A proceeds to Step S2.

That is, if the paper P is long paper, the switching gate G2 is not switched, so that the paper P keeps being sent forward along the sending-forward/backward section R31 to the second paper refeeding section R33, and is conveyed along the second paper refeeding section R33 to the image forming path 22.

On the other hand, when determining that the paper P is not long paper (Step S10: NO), the controller 11A switches the switching gate G2 (Step S7), and then returns to Step S2 to repeat Step S2 and the subsequent step(s).

As described above, according to the image forming apparatus 300 of the seventh embodiment, the circulation path R3 includes the second paper refeeding section R33 that is continuous with the downstream-side end of the sending-forward/backward section R31 in the paper conveying direction, and makes the paper P meet the image forming path 22 on the upstream side of the image former 10 in the paper conveying direction without being sent backward, and in the overwriting process, the controller 11A determines whether to (i) convey the paper P to the paper refeeding section R32 via the shortcut path R4 or (ii) convey the paper P to the second paper refeeding section R33 via the sending-forward/backward section R31 according to the length of the paper P in the paper conveying direction.

This makes it possible to select an appropriate conveyance path according to the length of the paper P in the paper conveying direction.

Further, according to the image forming apparatus 300 of the seventh embodiment, the second paper refeeding section R33 is arranged such that the paper P runs near the bottom of the image forming apparatus 300.

This allows the second paper refeeding section R33 to have a long straight portion, and accordingly can suppress jams of the paper P.

Further, the second paper refeeding section R33 can be used, in addition to the above, to change the conveying order of sheets of the paper P by keeping the sheets on the second paper refeeding section R33, for example.

In the sixth and seventh embodiments, the controller 11A performs the overwriting process of performing image forming on the same side of the paper P multiple times. Other than the overwriting process, the controller 11A can also perform, for example, a process of circulating the paper P having an image(s) and, from the second time (i.e. from the second circulation), making the paper P pass through the fixing device 50 without image forming, thereby controlling glossiness of images.

Further, in the sixth and seventh embodiments, the image forming unit 10W that forms toner images of white (W) as a spot color is provided. However, the spot color is not limited to white, and may be clear (transparent) or the like.

Further, in the sixth and seventh embodiments, there is provided only one image forming unit which forms toner images of a spot color. However, there may be provided two or more image forming units each of which forms toner images of a spot color so as to form toner images of two or more spot colors.

Needless to say, there may be provided no image forming unit that forms toner images of a spot color.

Further, the image forming apparatuses 200 and 300 of the sixth and seventh embodiments can perform the preheating control and/or the curl prevention control, too.

Further, although in the first to seventh embodiments, the image forming apparatus is an electrophotographic image forming apparatus, the present invention is applicable to image forming apparatuses adopting other image forming methods, such as an inkjet method. Further, the transfer method is not limited to that described in the above embodiments, either.

Further, in the above, as a computer readable medium for the programs of the present invention, a nonvolatile memory, a hard disk or the like is used. This is not intended to limit the present invention. The computer readable medium may be a portable recording/storage medium, such as a CD-ROM. Further, as a medium to provide data of the programs of the present invention, a carrier wave can be used.

In addition to the above, the specific configurations and the specific operations of the components/devices constituting the image forming apparatus can also be appropriately modified without departing from the scope of the present invention.

Although several embodiments of the present invention have been described and illustrated in detail, the disclosed embodiments are made for purposes of illustration and example only and not limitation. The scope of the present invention should be interpreted by terms of the appended claims.

The entire disclosure of Japanese Patent Applications No. 2017-136754 filed on Jul. 13, 2017 and No. 2017-138694 and No. 2017-138695 both filed on Jul. 18, 2017 is incorporated herein by reference in its entirety.

What is claimed is:

1. An image forming apparatus comprising:

an image former that forms a toner image on paper;

a fixing device that fixes by heat the toner image formed on the paper by the image former; an image forming path along which the paper is conveyed to the image former and the fixing device;

a circulation path that (i) diverges from the image forming path on a downstream side of the fixing device in a paper conveying direction and (ii) meets the image forming path on an upstream side of the image former in the paper conveying direction so as to circulate the paper such that an image forming side of the paper is unchanged; and a hardware processor that performs paper heating control to (i) make the paper pass through the heated fixing device without image forming on the paper, thereby heating the paper, and (ii) re-convey the paper via the circulation path to the image former.

2. The image forming apparatus according to claim 1, wherein the hardware processor determines whether or not to perform the paper heating control based on a predetermined image forming condition.

3. The image forming apparatus according to claim 2, wherein the predetermined image forming condition includes at least one of a type, an environment and the image forming side of the paper.

4. The image forming apparatus according to claim 3, wherein the hardware processor performs the paper heating control if the type of the paper is long paper or, thick paper.

5. The image forming apparatus according to claim 1, wherein the hardware processor repeatedly performs the paper heating control on the same paper until a temperature in the image forming apparatus reaches a predetermined temperature.

6. The image forming apparatus according to claim 1, wherein the hardware processor performs the paper heating control on a predefined number of sheets of the paper from a start of a job.

7. The image forming apparatus according to claim 1, wherein the hardware processor performs either a first mode in which an image having a first glossiness is formed on the paper or a second mode in which an image having a second glossiness lower than the first glossiness in the first mode is formed on the paper, and in the second mode, the hardware processor makes a fixing temperature in the fixing device a second temperature that is lower than a first temperature in the first mode, and performs the paper heating control.

8. The image forming apparatus according to claim 1, comprising a reverse path that (i) diverges from the image forming path on the downstream side of the fixing device in the paper conveying direction and (ii) meets the image forming path on the upstream side of the image former in the paper conveying direction so as to circulate the paper such that the image forming side of the paper is changed to an opposite side.

9. The image forming apparatus according to claim 1, wherein the circulation path includes: a sending-forward/backward section that diverges from the image forming path on the downstream side of the fixing device in the paper conveying direction so as to send the paper backward after sending the paper forward until a bottom of the paper reaches a predetermined point; and a paper refeeding section that makes the paper meet the image forming path on the upstream side of the image former in the paper conveying direction, the paper being sent backward along the sending-forward/backward section.

10. The image forming apparatus according to claim 9, wherein the circulation path includes a shortcut path that diverges from the sending-forward/backward section on the upstream side of the predetermined position in the paper conveying direction so as to convey the paper to the paper refeeding section without sending the paper backward.

11. An image forming apparatus comprising:

an image former that forms a toner image on paper;

a fixing device that fixes by heat the toner image formed on the paper by the image former;

an image forming path along which the paper is conveyed to the image former and the fixing device;

a reverse path that (i) diverges from the image forming path on a downstream side of the fixing device in a paper conveying direction and (ii) meets the image forming path on an upstream side of the image former in the paper conveying direction so as to circulate the paper such that an image forming side of the paper is changed to an opposite side; and a hardware processor that performs paper heating control to (i) make the paper pass through the heated fixing device without image forming on the paper, thereby heating the paper, and (ii) re-convey the paper via the reverse path to the image former to perform image forming on the opposite side.

12. The image forming apparatus according to claim 11, wherein the hardware processor determines whether or not to perform the paper heating control based on a predetermined image forming condition.

13. The image forming apparatus according to claim 12, wherein the predetermined image forming condition includes at least one of a type, an environment and the image forming side of the paper.

14. The image forming apparatus according to claim 13, wherein the hardware processor performs the paper heating control if the type of the paper is thin paper.

15. The image forming apparatus according to claim 11, wherein the hardware processor repeatedly performs the paper heating control on the same paper until a temperature in the image forming apparatus reaches a predetermined temperature.

16. The image forming apparatus according to claim 11, wherein the hardware processor performs the paper heating control on a predefined number of sheets of the paper from a start of a job.

17. The image forming apparatus according to claim 11, wherein the hardware processor performs either a first mode in which an image having a first glossiness is formed on the paper or a second mode in which an image having a second glossiness lower than the first glossiness in the first mode is formed on the paper, and in the second mode, the hardware processor makes a fixing temperature in the fixing device a second temperature that is lower than a first temperature in the first mode, and performs the paper heating control.

18. An image forming method for an image forming apparatus including:

an image former that forms a toner image on paper;

a fixing device that fixes by heat the toner image formed on the paper by the image former;

an image forming path along which the paper is conveyed to the image former and the fixing device;

a circulation path that (i) diverges from the image forming path on a downstream side of the fixing device in a paper conveying direction and (ii) meets the image forming path on an upstream side of the image former in the paper conveying direction so as to circulate the paper such that an image forming side of the paper is unchanged; and a hardware processor, the image forming method comprising:

with the processor, performing paper heating control to (i) make the paper pass through the heated fixing device without image forming on the paper, thereby heating the paper, and (ii) re-convey the paper via the circulation path to the image former.

19. An image forming method for an image forming apparatus including:

an image former that forms a toner image on paper;

a fixing device that fixes by heat the toner image formed on the paper by the image former; an image forming path along which the paper is conveyed to the image former and the fixing device;

a reverse path that (i) diverges from the image forming path on a downstream side of the fixing device in a paper conveying direction and (ii) meets the image forming path on an upstream side of the image former in the paper conveying direction so as to circulate the paper such that an image forming side of the paper is changed to an opposite side; and a hardware processor, the image forming method comprising:

with the processor, performing paper heating control to (i) make the paper pass through the heated fixing device without image forming on the paper, thereby heating the paper, and (ii) re-convey the heated paper via the reverse path to the image former to perform image forming on the opposite side.

* * * * *